US005680738A

United States Patent [19]

Allen et al.

[11] Patent Number: 5,680,738

[45] Date of Patent: Oct. 28, 1997

[54] STEEL FRAME STRESS REDUCTION CONNECTION

[75] Inventors: Clayton Jay Allen, Laguna Niguel; James Edward Partridge, Pasadena, both of Calif.; Ralph Michael Richard, Tucson, Ariz.

[73] Assignee: Seismic Structural Design Associates, Inc., Mission Viejo, Calif.

[21] Appl. No.: 522,740

[22] Filed: Sep. 1, 1995

Related U.S. Application Data

[63] Continuation-in-part of Ser. No. 419,671, Apr. 11, 1995.

[51] Int. Cl.[6] ..... E04C 3/30

[52] U.S. Cl. ..... 52/729.1; 52/653.1; 52/736.2; 52/737.2

[58] Field of Search ..... 52/729.1, 736.2, 52/737.2, 656.9, 653.1, 650.3; 403/270, 271, 272, 265

[56] References Cited

U.S. PATENT DOCUMENTS

| | | | |
|---|---|---|---|
| Re. 22,905 | 8/1947 | Scheyer . | |
| 1,320,072 | 10/1919 | Long | 52/729.1 X |
| 1,594,505 | 8/1926 | Frye . | |
| 1,813,118 | 7/1931 | Edwards et al. . | |
| 1,883,376 | 10/1932 | Hilpert et al. . | |
| 2,822,897 | 2/1958 | Peterson . | |
| 3,295,288 | 1/1967 | Bakke et al. | 52/737.2 X |
| 3,716,957 | 2/1973 | Bernardi | 52/729.1 X |
| 3,716,959 | 2/1973 | Bernardi . | |
| 4,129,974 | 12/1978 | Ojalvo | 52/729.1 |
| 4,905,436 | 3/1990 | Matsuo et al. | 52/737.2 X |
| 5,148,642 | 9/1992 | Plumier et al. . | |

FOREIGN PATENT DOCUMENTS

| | | | |
|---|---|---|---|
| 404339935 | 11/1992 | Japan | 52/737.2 |
| 406313334 | 11/1994 | Japan | 52/736.2 |

OTHER PUBLICATIONS

American Welding Society, Steel Structural Welding Code 1994, ANSI/AWS D1. Jan. 1994, pp. 57–61.

Engelhardt, et. al, "Cyclic–Loading Performance of Welded Flange–Bolted Web Connections", Dec. 1993, ASCE Journal of Structural Engineering, vol. 119, No.12, pp. 3537–3550.

Manual of Steel Construction Allowable Stress Design, American Institute of Steel Construction, Inc., 9th Ed., 1989, Chapter J, Connections, Joints and Fasteners, pp. 5–161 through 5–183.

Moment Frame Connection Strain and Deflection for Tests 1–11, 30 & 33, 34 and 35 by Jay Allen, Ralph Richard and James Partridge Feb. 10, 1995.

*Primary Examiner*—Carl D. Friedman
*Assistant Examiner*—Timothy B. Kang
*Attorney, Agent, or Firm*—Small Larkin & Kiddé

[57] ABSTRACT

The present invention relates to improvement of strength performance of connections in structural steel buildings made typically with rolled structural shapes, specifically in beam-to-column connections made with bolt or riveted weld web connections and welded flanges, to greatly reduce the very significant uneven stress distribution found in the conventionally-designed connection at the column/beam weld, through use of slots in column and/or beam webs with or without continuity plates in the area of the column between the column flanges, as well as, optionally, extended shear connections with additional columns of bolts for the purpose of reducing the stress concentration factor in the center of the flange welds.

14 Claims, 20 Drawing Sheets

STEEL FRAME STRESS REDUCTION CONNECTION

This application is a continuation-in-part of copending U.S. application Ser. No. 08/419,671, filed Apr. 11, 1995, and is incorporated by reference herein.

BACKGROUND OF THE INVENTION

A. Field of the Invention

The present invention relates broadly to load bearing and moment frame connections. More specifically, the present invention relates to connections formed between beams and/or columns, with particular use, but not necessarily exclusive use, in steel frames for buildings, in new construction as well as modification to existing structures.

B. Discussion of the Invention

In the construction of modern structures such as buildings and bridges, moment frame steel girders and columns are arranged and fastened together, using known engineering principles and practices to form the skeletal backbone of the structure. The arrangement of the girders, also commonly referred to as beams, and/or columns is carefully designed to ensure that the framework of girders and columns can support the stresses, strains and loads contemplated for the intended use of the bridge, building or other structure. Making appropriate engineering assessments of loads represents application of current design methodology which is compounded in complexity when considering loads for seismic events, and determining the stresses and strains caused by these loads in structures, are compounded in areas where earthquakes occur. It is well known that during an earthquake, the dynamic horizontal and vertical inertia loads and stresses, imposed upon a building, have the greatest impact on the connections of the beams to columns which constitute the earthquake damage resistant frame. Under the high loading and stress conditions from a large earthquake, or from repeated exposure to milder earthquakes, the connections between the beams and columns can fail, possibly resulting in the collapse of the structure and the loss of life.

The girders, or beams, and columns used in the present invention are conventional I-beam, W-shaped sections or wide flange sections. They are typically one piece, uniform steel rolled sections. Each girder and/or column includes two elongated rectangular flanges disposed in parallel and a web disposed centrally between the two facing surfaces of the flanges along the length of the sections. The column is typically longitudinally or vertically aligned in a structural frame. A girder is typically referred to as a beam when it is latitudinally, or horizontally, aligned in the frame of a structure. The girder and/or column is strongest when the load is applied to the outer surface of one of the flanges and toward the web. When a girder is used as a beam, the web extends vertically between an upper and lower flange to allow the upper flange surface to face and directly support the floor or roof above it. The flanges at the end of the beam are welded and/or bolted to the outer surface of a column flange. The steel frame is erected floor by floor. Each piece of structural steel, including each girder and column, is preferably prefabricated in a factory according to predetermined size, shape and strength specifications. Each steel girder and column is then, typically, marked for erection in the structure in the building frame. When the steel girders and columns for a floor are in place, they are braced, checked for alignment and then fixed at the connections using conventional riveting, welding or bolting techniques.

While suitable for use under normal occupational loads and stresses, often these connections have not been able to withstand greater loads and stresses experienced during an earthquake. Even if the connections survive an earthquake, that is, don't fail, changes in the physical properties of the connections in a steel frame may be severe enough to require structural repairs before the building is fit for continued occupation.

SUMMARY OF THE INVENTION

The general object of the present invention is to provide new and improved beam to column connections. The improved connection reduces stress and/or strain in beam to column connections caused by both static and dynamic loading. The improved connection of the present invention extends the useful life of the steel frames of new buildings, as well as that of steel frames in existing buildings when incorporated into a retrofit modification made during repairs to existing buildings.

A further object is to provide an improved beam to column connection in a manner which generally evenly distributes static or dynamic loading, and stresses, across the connection so as to minimize high stress concentrations along the connection.

Another object of the present invention is to reduce a dynamic loading stress applied between the beam and the column flange connection of a steel frame structure.

Yet another object of the present invention is to reduce the variances in dynamic loading stress across the connection between the column and beam.

It is yet another object of the present invention to reduce the variances in dynamic loading stress across the beam to column connection by incorporation of at least one, and preferably several slots in the column web and/or the beam web near the connection of the beam flanges to the column flange.

It is yet another object of the present invention to reduce the strain rate applied between the beam and column flange of a steel frame structure during dynamic loading.

It is yet another object of the present invention to provide a means by which the plastic hinge point of a beam in a steel frame structure may be displaced along the beam away from the beam to column connection, if this feature may be desired by the design engineer.

Finally, it is an object of the present invention to reduce the stresses and strains across the connection of the column and beam of a steel frame structure during static and dynamic loadings.

The present invention is based upon the discovery that non-linear stress and strain distributions due to static, dynamic or impact loads created across a full penetration weld of upper and lower beam flanges to a column flange in a steel frame structure magnify the stress and strain effects of such loading at the vertical centerline of the column flange. Detailed analytical studies of typical wide flange beam to column connections to determine stress distribution at the beam/column interface had not been made prior to studies performed as part of the research associated with the present invention. Strain rate considerations, rise time of applied loads, stress concentration factors, stress gradients, residual stresses and geometrical details of the connection all contribute to the behavior and strength of these connections. By using high fidelity finite element models and analyses to design full scale experiments of a test specimen, excellent correlation has been established between the analytical and test results of measured stress and strain profiles at the beam/column interface where fractures occurred.

Location of the strain gauges on the beam flange at the column face was achieved by proper weld surface preparation. Dynamic load tests confirmed the analytically determined high strain gradients and stress concentration factors. These stress concentration factors were found to be 4 to 5 times higher than nominal design assumption values for a typical W 27×94 beam to W 14×176 column connection with no continuity plates. Stress concentration factors were reduced to between 3 and 4 times nominal stress level when conventional continuity plates were added. Incorporation of features of present invention into the connection reduces the high-non-uniform stress that exists with conventional design theory and has been analyzed and tested. The present invention changes the stiffness and rigidity of the connection and reduces the stress concentration factor to about 1.2 at the center of the extreme fiber of the flange welds. Explained in a different way, the condition of stress at a conventional connection of the upper and lower beam flanges at the column flange, the beam flanges exhibit non-linear stress and strain distribution. As part of the present invention it has been discovered that this is principally due to the fact that the column web, running along the vertical centerline of the column flanges provides additional rigidity to the beam flanges, primarily at the center of the flanges directly opposite the column web. The result is that the rigidity near the central area of the flange at the beam to column connection can be significantly greater than the beam flange rigidity at the outer edges of the column flange. This degree of rigidity varies as a function of the distance from the column web. In other words, the column flange yields, bends or flexes at the edges and remains relatively rigid at the centerline where the beam flange connects to the column flange at the web, thus causing the center potion of each of the upper and lower beam flanges to bear the greatest levels of stress and strain. It is believed that, with the stress and strain levels being non-linear across the beam to column connection, the effect of this non-linear characteristic can lead to failure in the connection initiating at the center point causing total failure of the connection. In addition, the effects of the state of stress described above are believed to promote brittle failure of the beam column or weld material.

To these ends, one aspect of the present invention includes use of vertically oriented reinforcing plates, or panels, disposed between the inner surfaces of the column flanges near the outer edges, on opposite sides, of the column web in the area where the upper and lower beam flanges connect to the column flange. The load or vertical panels alone create additional rigidity along the beam flange at the connection. This additional rigidity functions to provide more evenly distributed stresses and strains across the upper and lower beam flange connections to the column flange when under load. The rigidity of the vertical panels may be increased with the addition of a pair of horizontal panels, one on each side of the column web, and each connecting between the horizontal centerline of the respective vertical panels and the column web. With the addition of the panels, stresses and strains across the beam flanges are more evenly distributed; however, the rigidity of the column along its web, even with the vertical panels in place, still results in higher stresses and strains at the center of the beam flanges than at the outer edges of the beam flanges when under load.

Furthermore, as another aspect of the present invention, it has been discovered that a slot, preferably oriented generally vertical, cut into, and, preferably, completely through the column web, in the area proximate to where each beam flange connects to the column flange, reduces the rigidity of the column web in the region near where the beam flanges are joined to the column. The column slot includes, preferably two end, or terminus holes, joined by a vertical cut through the column with the slot tangentially connecting to the holes at the hole periphery closest to the column flange connected to the beam. The slot through the column web reduces the rigidity of the center portion of the column flange and thus reduces the magnitude of the stress applied at the center of the beam at the column flange connection.

As yet another aspect of the present invention, it has been discovered that, preferably, slots cut into and through the beam web in the area proximate to where both beam flanges connect to the column flange, further reduces the rigidity of the column web in the region where the beam flanges are joined to the column. The beam slots preferably extend from the end of the beam at the connection point to an end, or terminus hole, in the beam web. The beam slots are generally horizontally displaced. Preferably, one slot is positioned underneath, adjacent and parallel to the upper beam flange, and a second beam slot is positioned above, horizontally along, adjacent and parallel to the lower beam flange. The beam slots are located just outside of the flange web fillet area and in the web of the beam.

In accordance with conventional practice, it is also desirable to construct, or retrofit, steel frame structures such that the plastic hinge point of the beam will be further away from the beam to column connection than would occur in a conventional beam-to-flange connection structure. In accordance with this practice, it has also been discovered that, preferably, use of upper and lower double beam slots accomplishes this result. The first upper and lower beam slob are as described above. For each first beam slot, a second beam slot, each also generally a horizontally oriented slot is cut through the web of the beam. Each second beam slot is also positioned along the same center line as its corresponding first beam slot which terminates at the beam to column connection. It is preferred that each second beam slot have a length of approximately twice the length of its adjacent first beam slot, and be separated from its adjacent first beam slot by a distance approximately equal to the length of the first beam slot. The slots may vary in shape, and in their orientation, depending on the analysis results for a particular joint configuration.

As yet another aspect of the present invention, it has also been discovered that the column slots and/or beam slots of the present invention may be incorporated in structures that include not only the vertically oriented reinforcing plates as described above, but also with structures that include conventional continuity plates, or column-web stiffeners, as is well known in this field. When used in conjunction with conventional continuity plates, or column-web stiffeners, the generally vertically oriented column slots are positioned in the web of the column, such that the first slot extends vertically from a first terminus hole located above and adjacent to the continuity plate which is adjacent and co-planar to, that is, provides continuity to the upper beam flange, and terminates in a second terminus hole in the column web. A second column slot extends vertically downward from the continuity plate adjacent and co-planar to, that is, providing continuity with, the lower beam flange. In this aspect of the present invention, horizontally extending beam slots, whether single beam slots or double beam slots of the present invention, may also be used with steel frame structures that employ conventional continuity plates.

As yet another aspect of the present invention, it has also been discovered that, in conjunction with the horizontal beam slots of the present invention, the conventional shear plate may be extended in length to accommodate up to three columns of bolts, with conventional separation between bolts. The combination of the upper and/or lower horizontal beam slots and the conventional and/or lengthened shear plates may be used in conjunction with top down welding techniques, bottom up welding techniques or down hand welding techniques.

The present invention vertical plates with, or without, the slots of the present invention, or, the slots with, or without, vertical plates provide for beam to column connections which generally more evenly distribute, and reduce the maximum magnitude of, the stress and strain experienced in the beam flanges across a connection in a steel frame structure than are experienced in a conventional beam to column connection.

BRIEF DESCRIPTION OF THE DRAWINGS

The objects and advantages of the present invention will become more readily apparent to those of ordinary skilled in the art after reviewing the following detailed description and accompanying documents wherein:

FIG. 26 is a drawing showing stresses in the top beam flange top surface.

DESCRIPTION OF THE PREFERRED EMBODIMENTS

Referring to the FIGS., especially 1–4, 9–15, and 22–23, the skeleton steel frame used for seismic structural support in the construction of buildings in general frequently comprises a rigid or movement, steel framework of columns and beams connected at a connection. The connection of the beams to the columns may be accomplished by any conventional technique such as bolting, electric arc welding or by a combination of bolting and electric arc welding techniques.

Figure 22:
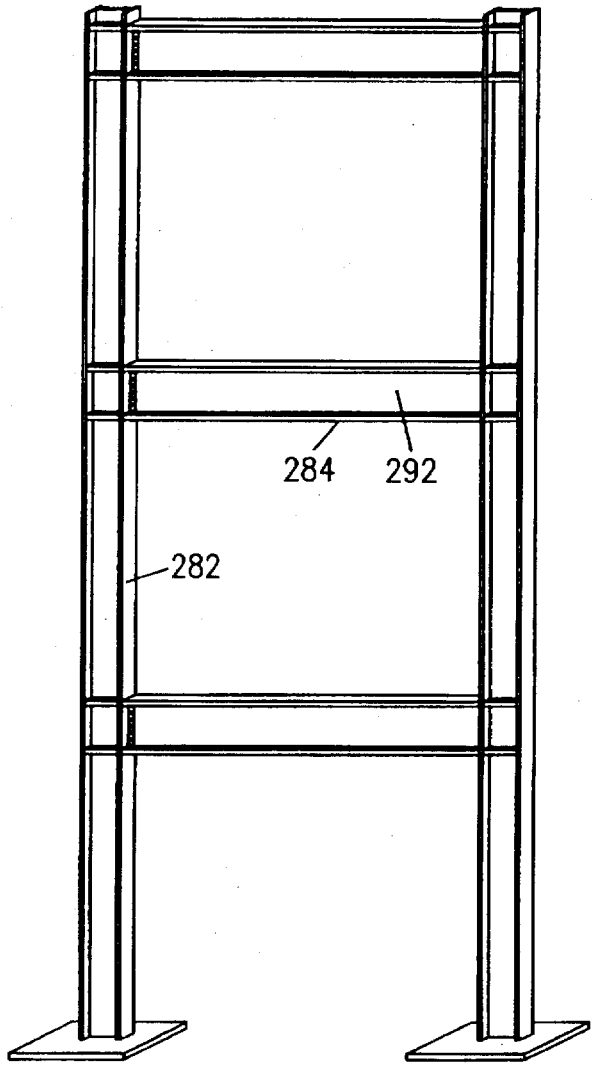
FIG. 22 is a perspective view of a conventional steel moment resisting frame.
Figure 23:
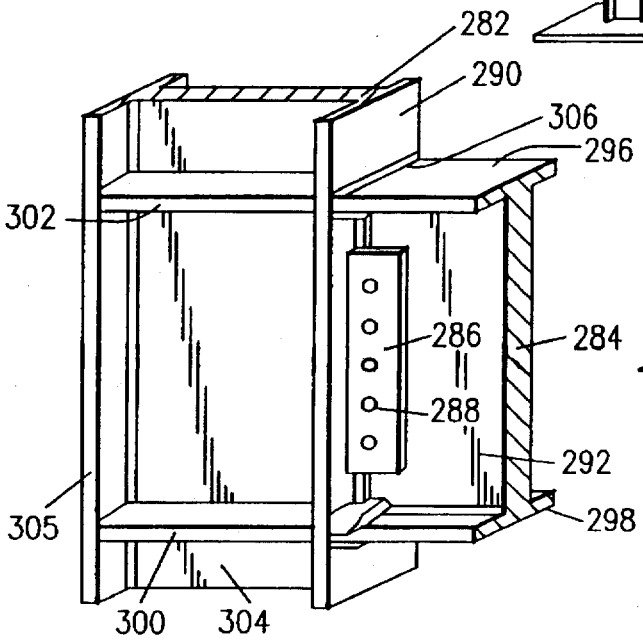
FIG. 23 is an enlarged, detailed perspective view of a conventional beam to column connection.

Referring to FIGS. 22 and 23, a conventional W 14×176 column 282 and a W 27×94 beam 284 are conventionally joined by shear plate 286 and bolts 288 and welded at the flanges. The column 282 includes bolt shear plate 286 welded at a lengthwise edge along the lengthwise face of the column flange 290. The shear plate 286 is made to be disposed against opposite faces of the beam web 292 between the upper and lower flanges 296 and 298. The shear plate 286 and web 292 include a plurality of pre-drilled holes. Bolts 288 inserted through the pre-drilled holes secure the beam web between the shear plates. Once the beam web 292 is secured by bolting, the ends of the beam flanges 296 and 298 are welded to the face of the column flange 290. Frequently, horizontal stiffeners, or continuity plates 300 and 302 are required and are welded to column web 304 and column flanges 290 and 305. It has been discovered that, under seismic impact loading, region 306 of beam to column welded connection experience stress concentration factors in the order of 4.5–5.0 times nominal stresses. Additionally, it has been discovered that non-uniform strains and strain rates exist when subjected to seismic or impact loadings associated primarily with the geometry of the conventional connection.

Column Load Plates, Support Plates And Slot Features of the Present Invention

In a first preferred embodiment and for asserting in maintaining the structural support of the connection under static, impact or dynamic loading conditions, such as during an earthquake, a pair of load plates 16 and 18 are provided disposed lengthwise on opposite sides of the column web 20 of column 10 between the inner faces 22 and 24 of the column flanges 26 and 28 and welded thereto by a partial penetration weld within the zone where the beam flanges 29 and 30 of beam 12 contact the column flange 28. Respective horizontal plates 32 and 34 are positioned along the lengthwise centerline of the vertical plates 16 and 18, respectively, and connected to the vertical plates 16 and 18, respectively, and the web 20, for added structural support. The support plate surfaces 36 and 38 are, preferably, trapezoidal in shape. Plate 36 has a base edge 40 extending along the lengthwise centerline of the load plate 16, and a relatively narrow top which is welded along and to the web 20. The vertical plates 16 and 18 are preferably positioned along a plane parallel to the web 20 but at a distance from web 20 less than the distance to the respective edges of the column flanges 40 and 42. The preferred distance is such that the rigidity of the column flange is dissipated across its width in the zone where the beam flanges 29 and 30 are connected to the column 10. The horizontal and vertical support plates are, preferably, made of the same material as the column to which they are connected.

Figure 7:
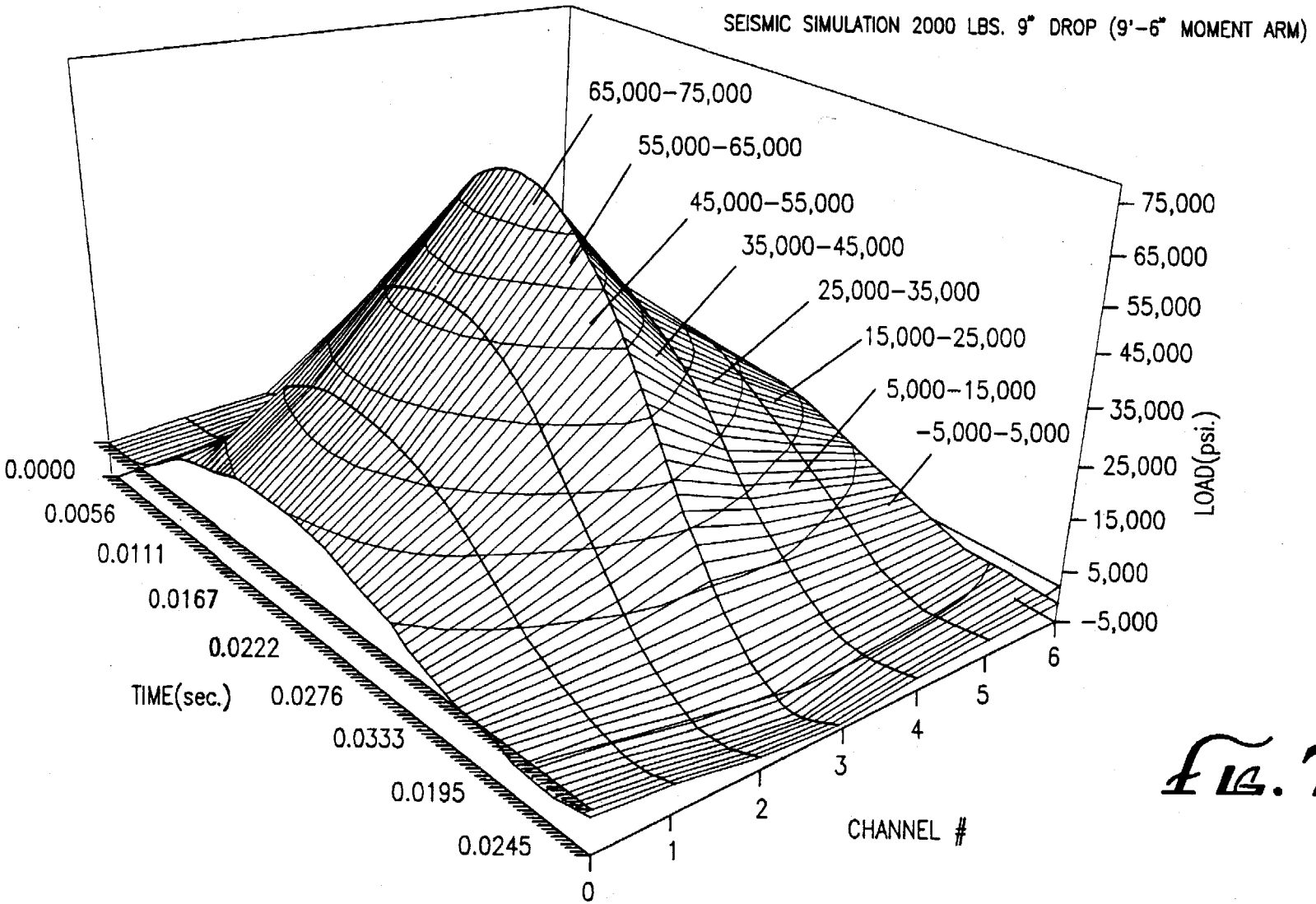
FIG. 7 is a three dimensional depiction of the graph shown in FIG. 5.
Figure 8:
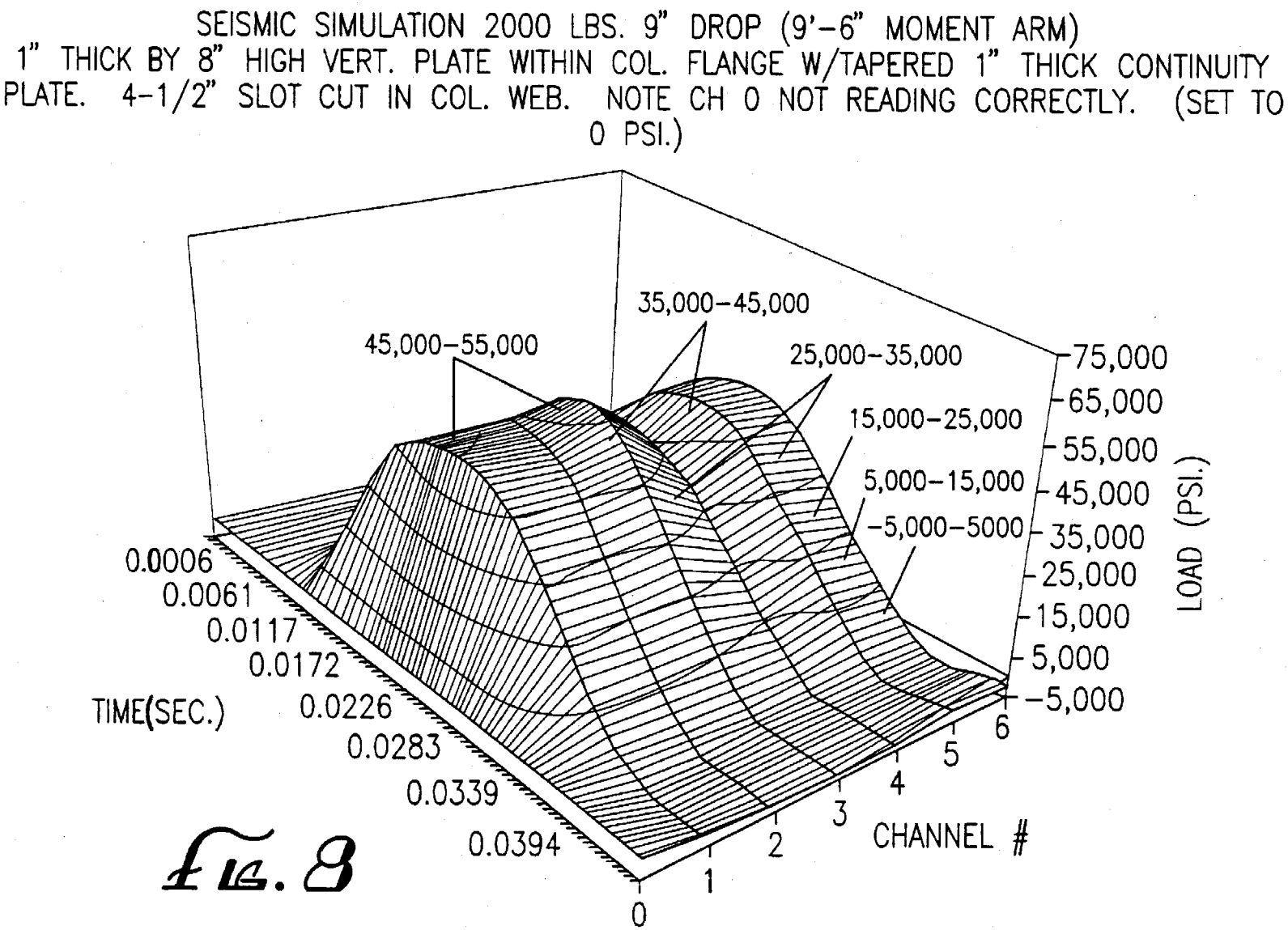
FIG. 8 is a three dimensional depiction of the graph shown in FIG. 6.

Experiments have shown that the load plates 16 and 18, by increasing rigidity, function to help avenge the stresses and strain rates across the beam flanges 29 and 30 at the connections and decrease the magnitude of stress measured across the beam flanges 29 and 30, but do not significantly reduce the magnitude of the stress levels experienced at the center region of the beam flange. The load or column flange stiffener plates 16 and 18 alone, by creating near uniform stress in the connection function adequately to help to reduce fracture at the connection; however, it is also desirable to reduce the magnitude of stress measured at the center of the beam flanges 29 and 30 and may be further reduced by a slot 44. The column web slot 44, cut longitudinally, is useful at a length range of 5 per cent to 25 per cent of beam depth cut at or near the toe 45 of the column fillet 47 within the column web 20 centered within the zone where the beam flanges 29 and 30 are attached proximate to the connection. The slot 44 serves to reduce the rigidity of the column web 20 and allows the column flange 28 center to flex slightly, thereby reducing the magnitude of stress in the center of the beam flanges. The vertical plates 16 and 18 with or without the web slot 44 function to average out the magnitude of stress measured across the beam connection 14. By equalizing, as much as possible, the stress and strain concentrations along the beam flanges 29 and 30, the stress variances within the beam 12 are minimized at the connection. In addition, a thus constructed connection 14 evenly distributes the magnitude of stress across the weld to ensure that the connection 14 is supported across the column flange 28 during static, impact or dynamic loading conditions. As shown in FIG. 8, when the load plates 16 and 18 and slot 44 are incorporated in the structure at column 10 proximate to the connection 14, strain rates measured across the beam flanges 29 and 30 appear more evenly distributed, and the magnitude of stress across the beam flange edge 46, has a substantially reduced variation across the beam in comparison to the variation shown in FIG. 7.

In a preferred embodiment, a conventional W 14×176 column 10 and a W 27×94 beam 12 are conventionally joined by mounting plate 48 and bolts 50 and welded at the flanges. The column 10 includes shear connector plate 48 welded at a lengthwise edge along the lengthwise face of the column flange 28. The mounting plate 48 is made to be disposed against opposite faces of the beam web 52 between the upper and lower flanges 29 and 30. The mounting plate 48 and web 52 include a plurality of pre-drilled holes. Bolts 50 inserted through the pre-drilled holes secure the beam web between the mounting plates. Once the beam web 52 is secured by bolting, the ends of the beam flanges 29 and 30 are welded to the face of the column flange 28. The combination of the bolt and welding at the connection rigidly secures the beam 12 and column 10 to provide structural support under the stress and strain of normal loading conditions.

Figure 1:
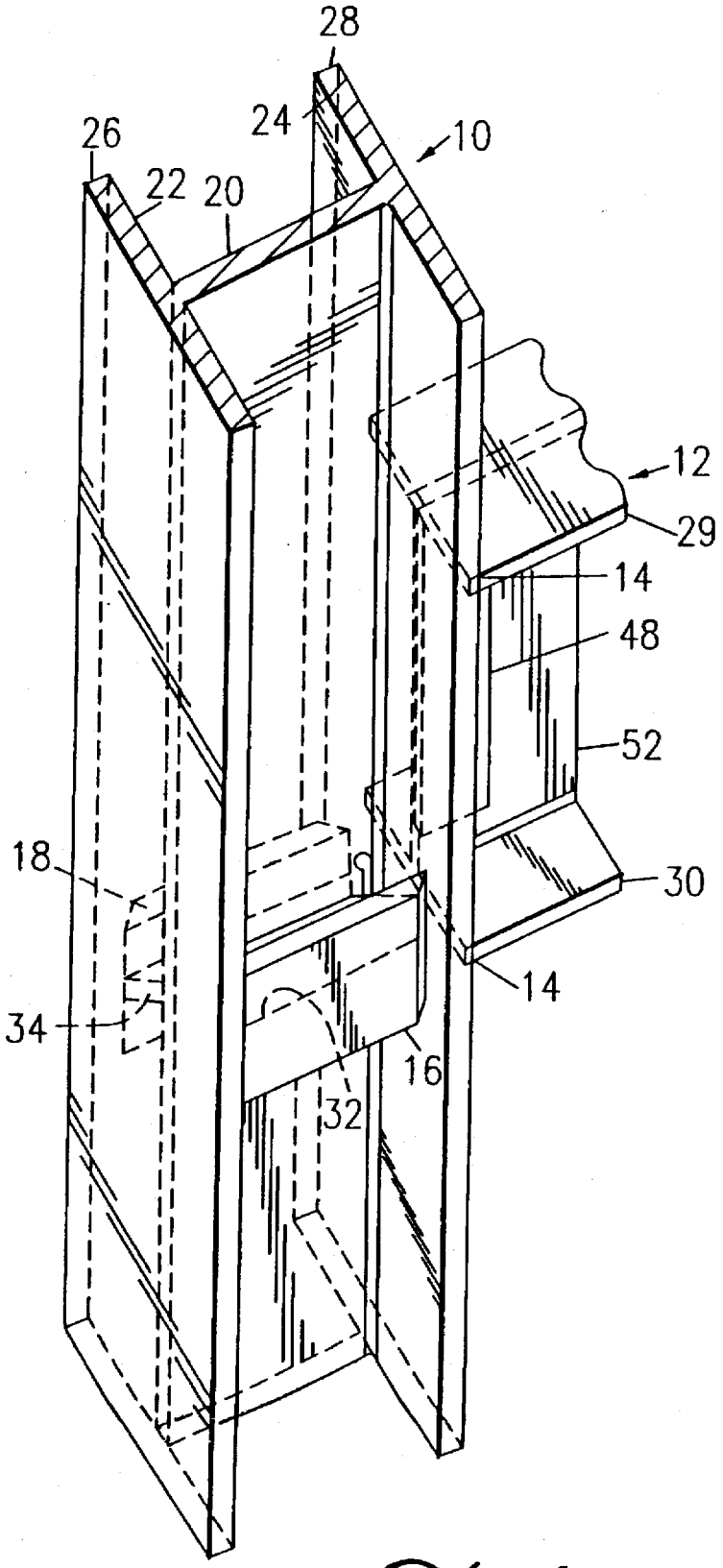
FIG. 1 is a perspective view of a first preferred embodiment of the present invention.
Figure 2:
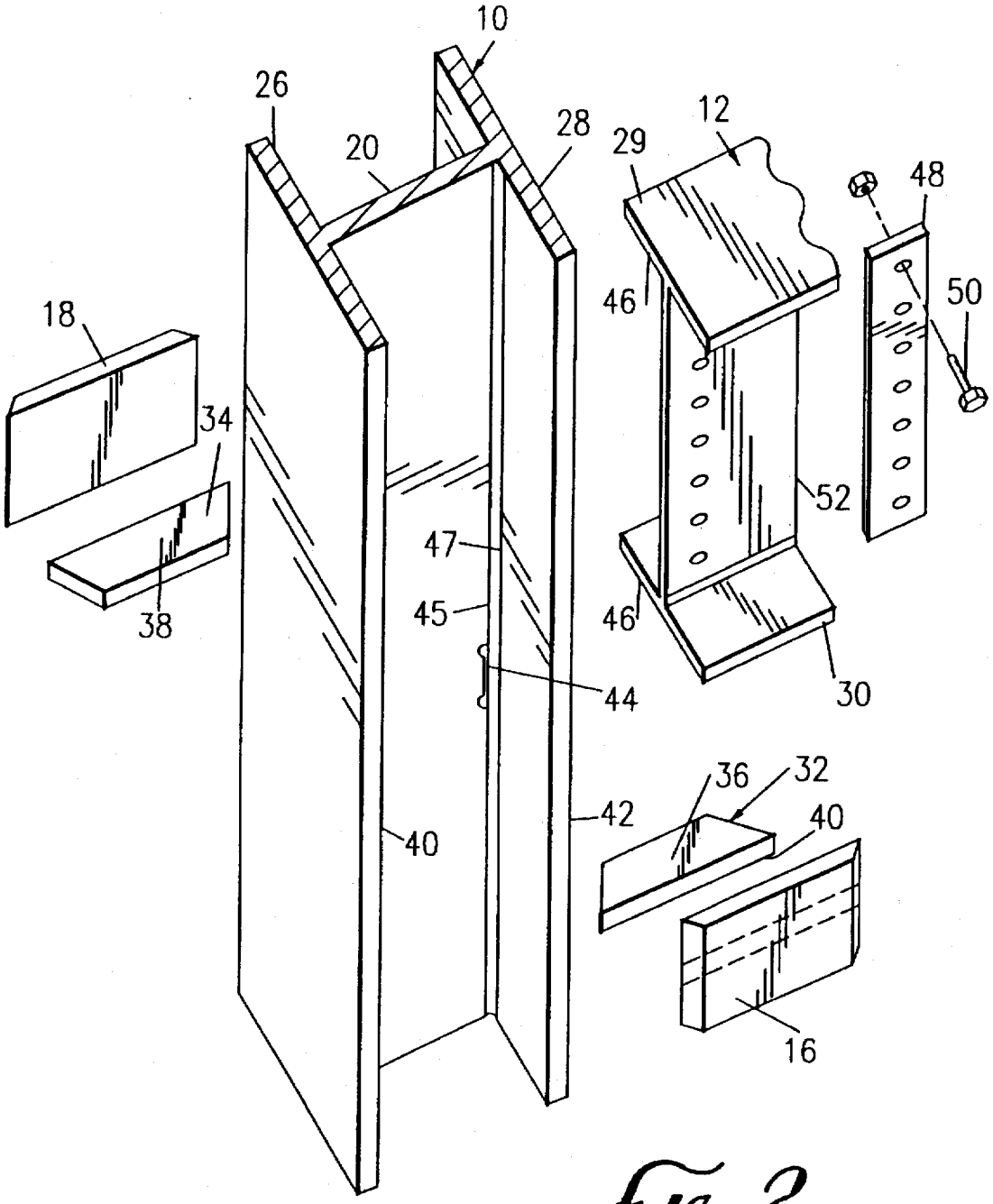
FIG. 2 is an exploded view of the connection for supporting dynamic loading of FIG. 1.
Figure 3:
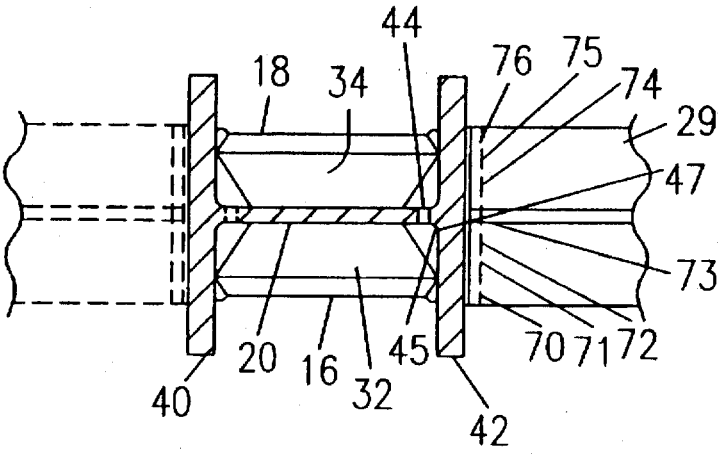
FIG. 3 is a top view of the connection for supporting dynamic loading of FIG. 1.
Figure 4:
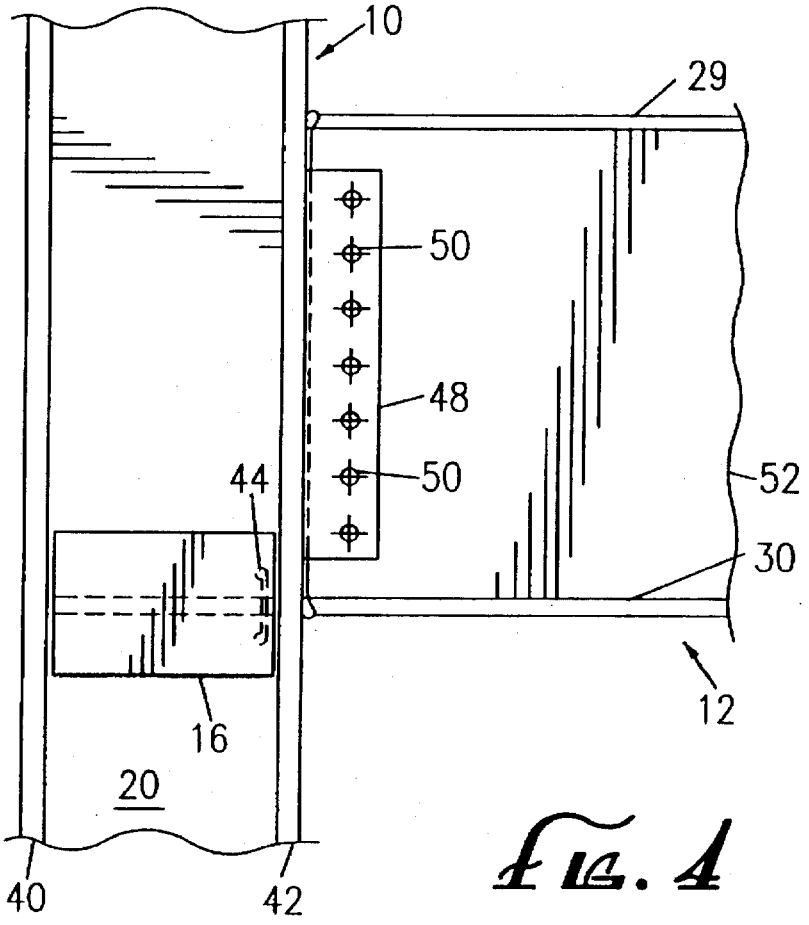
FIG. 4 is a side view of the connection for supporting dynamic loading of the present invention of FIG. 1.
Figure 5:
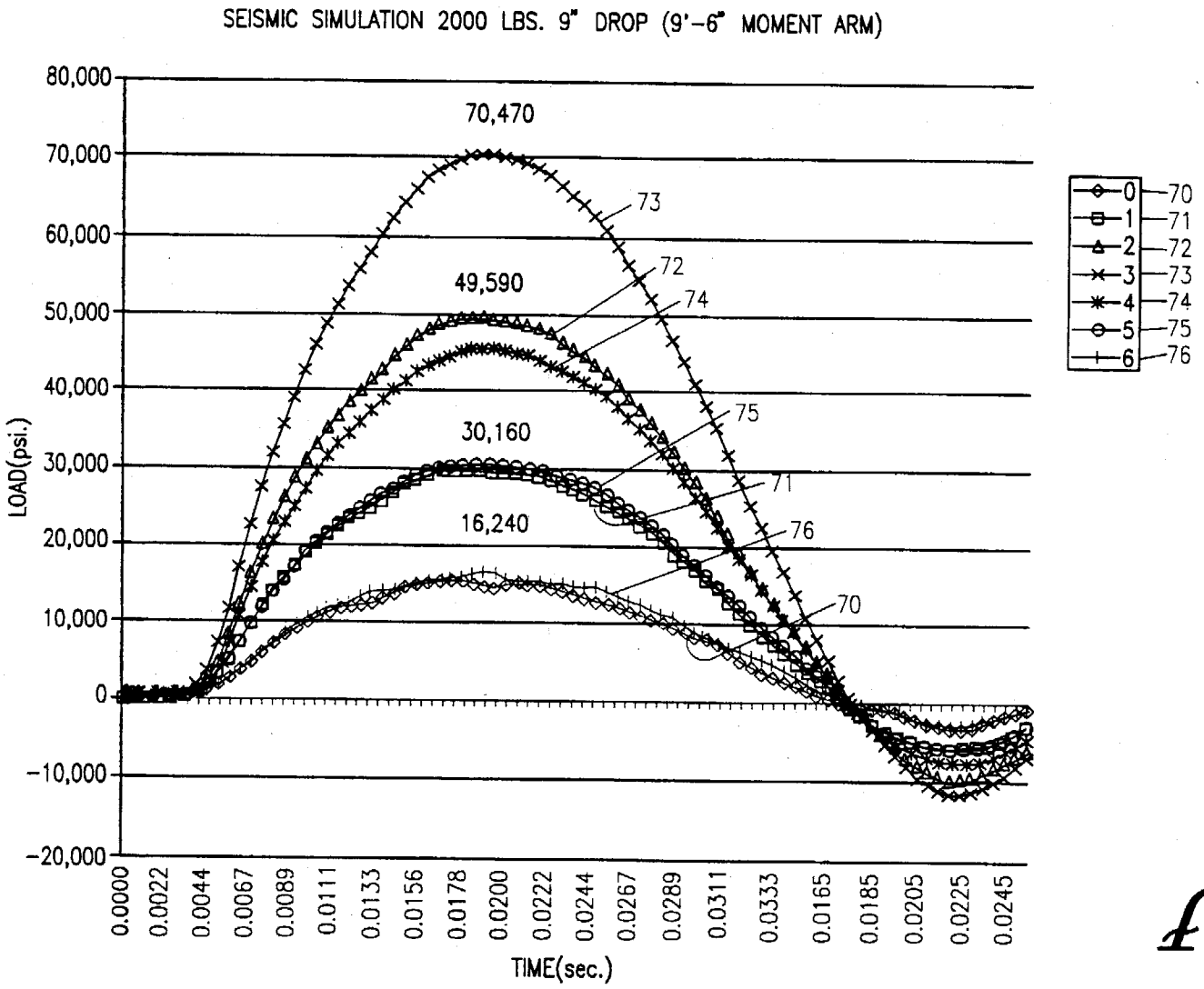
FIG. 5 is a graph of the stress and strain rates caused by dynamic loading in a conventional connection.
Figure 6:
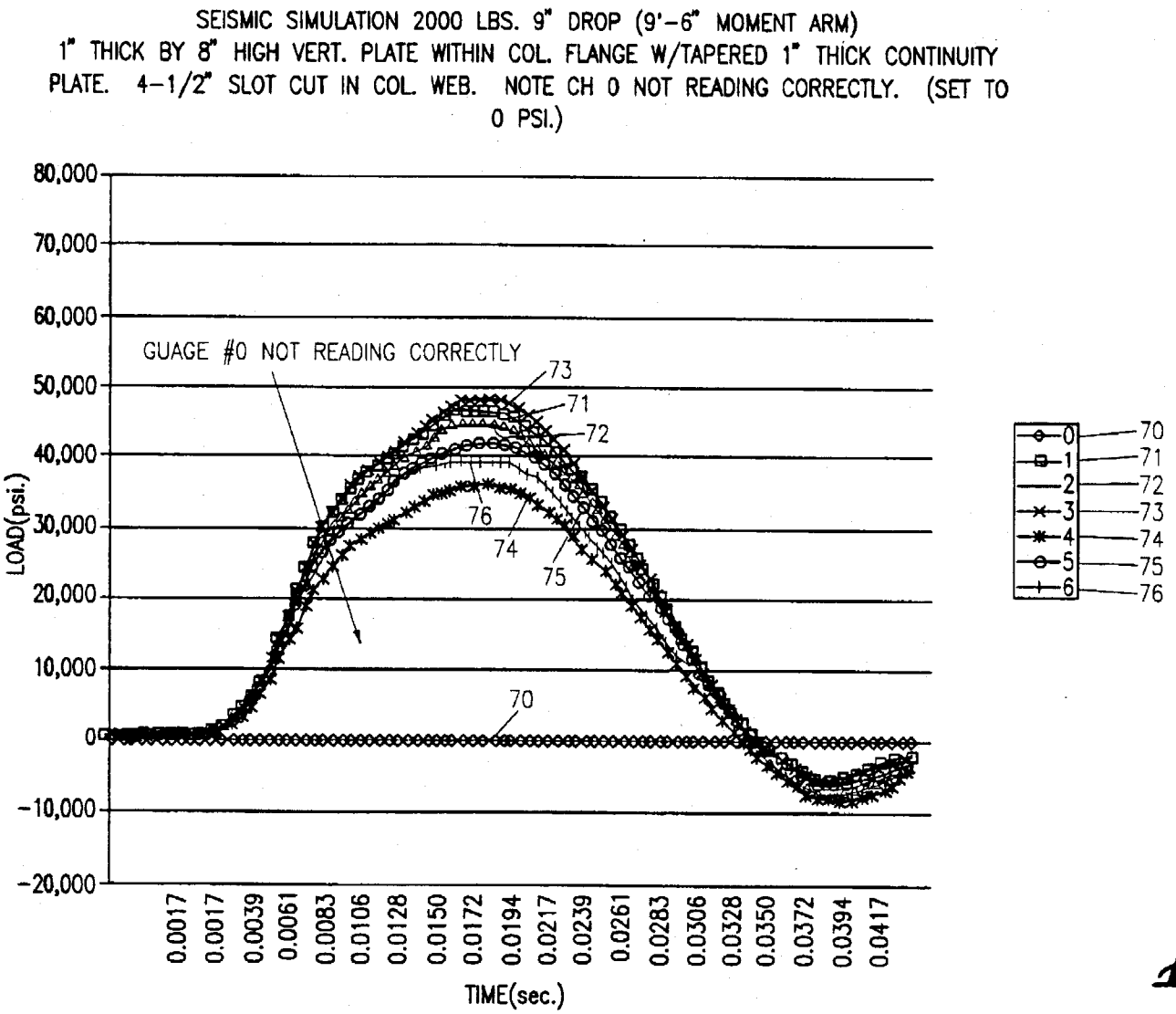
FIG. 6 is a graph of the stress and strain rates caused by dynamic loading in the connection of FIG. 1.
Figure 24:
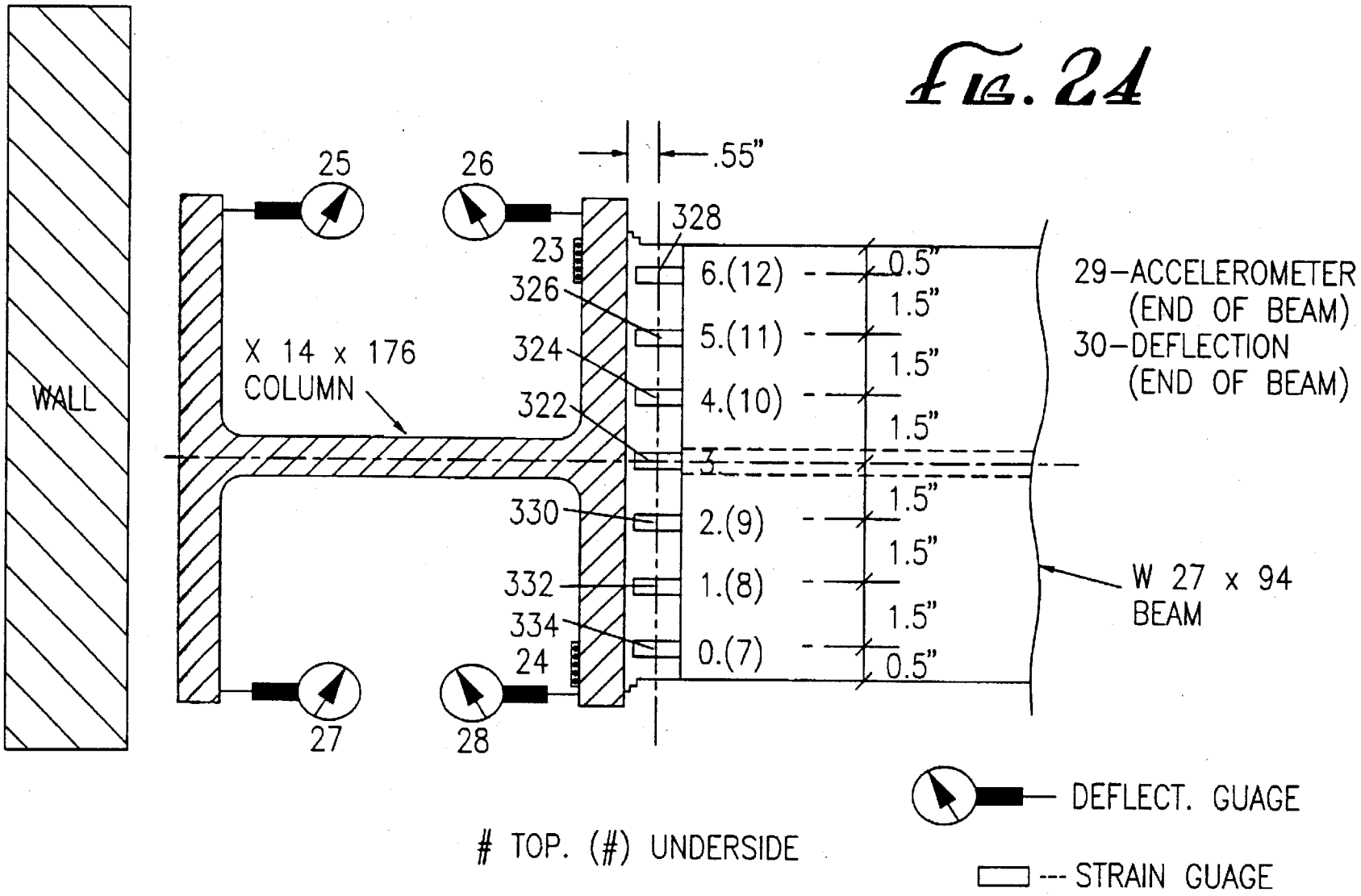
FIG. 24 is a side view of a beam to column connection illustrating location of strain measurement devices.

Under the static, impact or dynamic loading of the connection 14, this configuration alone does not provide sufficient support for the stresses and strains experienced under such conditions. For purposes of this invention, stress is defined as the intensity of force per unit area and strain is defined as elongation per unit length, as shown in FIGS. 5 and 6, a seismic simulation of loads measured at seven equidistant points 70–78 width-wise across the beam flange in psi over time during an earthquake, results in a significantly greater stress magnitude measured at the center 73 of the beam flange. In addition, the slope of increasing stress levels shown in the graph represents uneven acquisition of strain at different points 70–76 along the beam flange. FIG. 24 shows the exact location of the strain measurement devices in relation to the center line of the column. As the measurements are taken further away from the center 73 of the column flange along the beam flange edge, the levels of stress are reduced significantly at each pair of measurement points 72 and 74, 71 and 75, 70 and 76, i.e., as the distance extends outward on the beam flange away from the center. The results show that the beam flange 29 at the connection 14 experiences both the greatest level of the stress and the greatest level of strain at the center of the beam web to column flange connection at the centerline of the column web. The connection 14 configuration represents the zone of either or both the upper 29 and lower 30 beam flange. The column web slot 44 cut lengthwise in the column web 20 centered within the zone of the lower beam flange connection 30 is generally about ¾ of inch from the inner face of the column flange near the beam flange connection. In the preferred embodiment, slot widths in the range of 4 to 8 inches in length are preferred. The best results at ¾ of an inch from the flange were achieved using a 4.5 inch length slot with a 0.25 inch width. Slots longer than eight inches may also be useful. A summary of the tests in which the preferred dimensions were discovered is disclosed in a 16-page test report entitled, "Moment Frame Connections Strain and Deflection for Tests #1–11–,30 & 33, 34 and 35" by Jay Allen, Ralph Richard and Jim Partridge on Feb. 10, 1995, enclosed with this application and incorporated by reference herein. Those skilled in the art will appreciate that the specific configurations and dimensions of the preferred embodiment may be varied to suit a particular application, depending upon the column and beam sizes used in accordance with the test results.

The load plates 16 and 18 and the respective support plates 32 and 34 are preferably made from a cut-out portion of a conventional girder section. The load plates comprising the flange surface and the support plates comprising the web of the cut-out portions. Alternatively, a separate load plate welded to a support plate by a partial penetration weld, with thicknesses adequate to function as described herein, would perform adequately as well. The horizontal plates 32 and 34, preferably, do not contact the column flange 28 because such contact would result in an increased column flange stiffness and as a consequence increased stress at that location, during dynamic loading such as occurs during an earthquake. Each support plate base 40 preferably extends lengthwise along the centerline of the respective load plates 16 and 18 to increase the rigidity of the load plate and is tapered to a narrower top edge welded width-wise across the column web 20. The, preferably, trapezoidal shape of the support plates surface provides gaps between the respective column flanges and the edges of the support plates. Such gaps establish an adequate open area for the flange to flex as a result of the slot 44 formed in the web within the gap areas.

Figure 9:
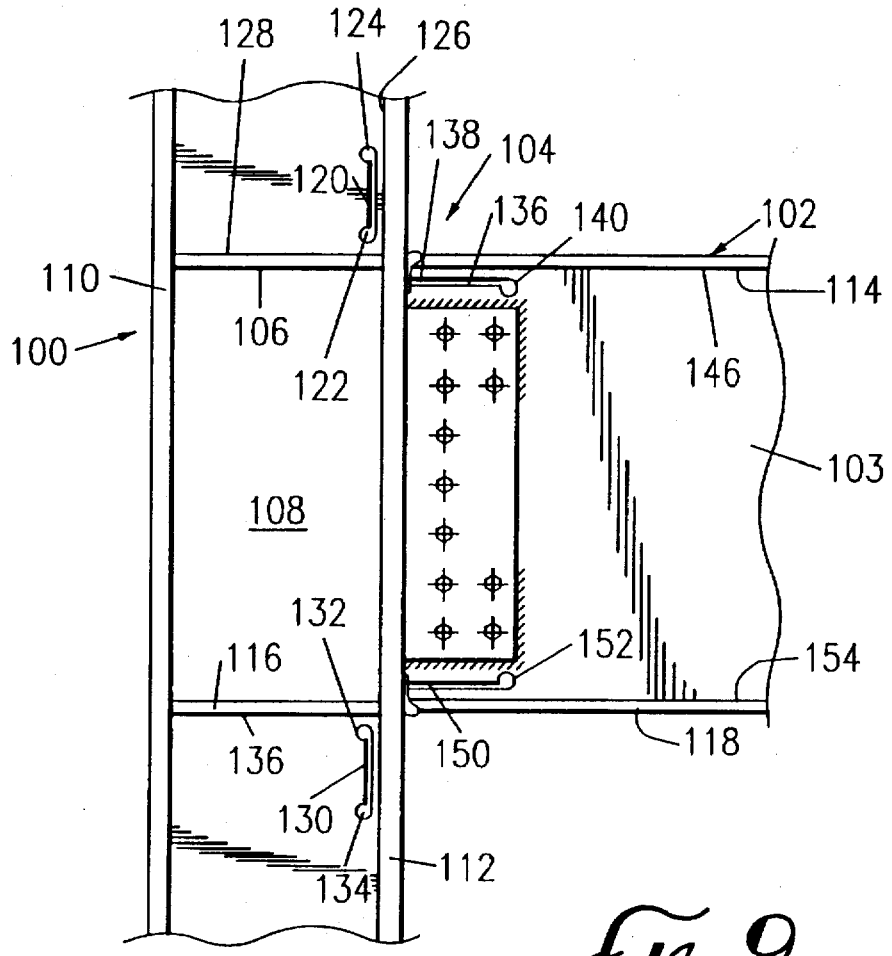
FIG. 9 is a side view of another preferred embodiment of the present invention including a column and beam connection, a conventional continuity plate, and vertical column slots and upper and lower beam slots of the present invention.
Figure 10:
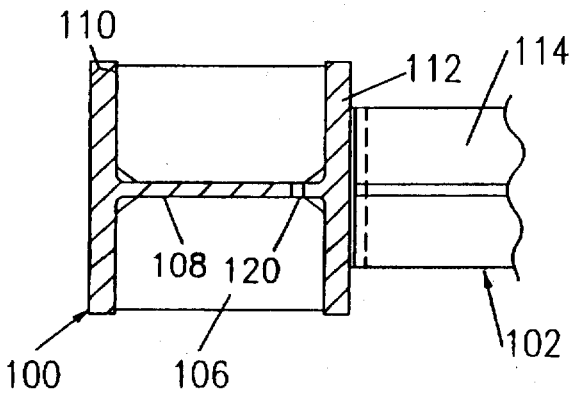
FIG. 10 is a top view of the FIG. 9 embodiment.

Column Slots With Conventional Column Continuity Plates Features of the Present Invention Referring to FIG. 9, column 100 is shown connected to beam 102 at connection 104, as described above. Upper conventional continuity plate, also commonly referred to as a stiffener, or column stiffener, 106 extends horizontally across web 108 of column 100 from left column flange 110 to right column flange 112. Plate 106 is co-planar with upper beam flange 114, is made of the same material as the column, and is approximately the same thickness as the beam flanges. Referring to the FIG. 10 top view, column 100, beam 102, column web 108 and top beam flange 114 are shown. Continuity plate 106, left and right column flanges 110 and 112 are also shown.

Again referring to FIG. 9, lower continuity plate 116 is shown to be co-planar with lower beam flange 118. Upper column slot 120 is shown extending through the thickness of column web 108, and is, preferably, vertically oriented along the inside of right column flange 112. The lower end, or terminus 122 of the slot 120, and the upper terminus 124 are holes, preferably drilled. In the case when the column is a W 14×176 inch steel column, the holes 120, 124 are preferably ¾ inch drilled holes, and the slot is ¼ inch in height and cut completely through the web. When connected to a W 27×94 steel beam, the preferred length of slot 120 is 6 inches between the centers of holes 122 and 124 and are tangential to the holes 122 and 124 at the periphery of the holes closest to the flange. The centers of holes 122 and 124 are also, preferably, ¾ inch from the inner face 126 of right column flange 112. The center of hole 122 is, preferably, 1 inch from the upper continuity plate 106. Positioned below lower continuity plate 106 is lower column slot 130, with upper and lower terminus holes 132 and 134, respectively. Lower column slot 130 preferably has the same dimension as upper column slot 120. Lower slot 130 is positioned in web 108, the lower face 136 of lower continuity plate 116, right column flange 112 and lower beam flange 118 in the same relative position as upper slot 120 is positioned with respect to continuity plate 106 and upper beam flange 114. The holes may vary in diameter depending on particular design application.

Beam Slots Features of the Present Invention

Figure 11:
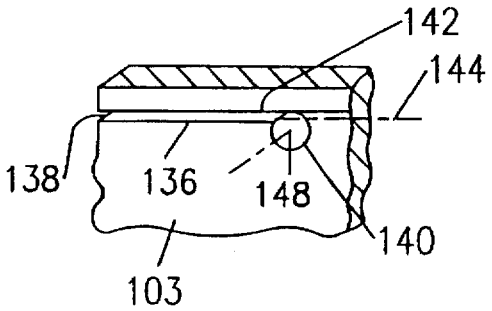
FIG. 11 is a detailed, perspective view of the upper, horizontal beam slot of the FIG. 9 embodiment.
Figure 12:
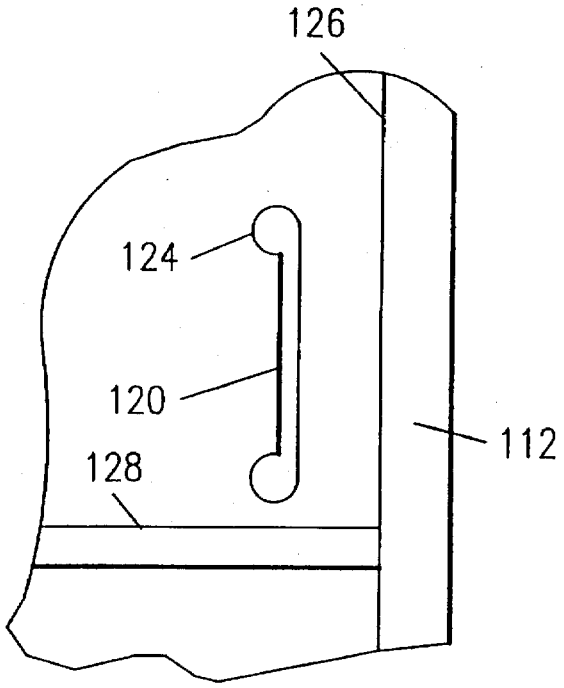
FIG. 12 is a detailed view of a column slot of the FIG. 9 embodiment.

Also referring to FIG. 9 invention is shown. Upper beam slot 136, shown in greater detail in FIG. 11, is shown as cut through the beam web and as extending in a direction generally horizontal and parallel to upper beam flange 114. A first end 138 of the beam slot, shown as a left end terminates at the column flange 112. The slot, for a typical W 27×94 steel beam, is preferably ¼ inch wide and is cut through the entire thickness of beam web 103. The second terminus 140 of the upper horizontal beam slot is a hole, preferably, 1 inch in diameter in the preferred embodiment. The center of the hole is positioned such that the upper edge 142 of the slot 136 is tangential to the hole, as more clearly shown in FIG. 11. Also, for a W 27×94 steel beam, the center line 144 of the slot 136 is ⅜ inch as from the lower surface 146 of the upper beam flange 114, with the center 148 of the hole being 1⅞ inches from the beam flange surface. The preferred slot length for this embodiment is 6 inches. Referring to FIG. 9, lower, horizontally extending beam slot 150 is shown. The lower beam slot 150 is tangential to the bottom of the corresponding terminus hole 152, and the dimensions of the slot and hole are the same as those for the upper beam slot. The lower beam slot 150 is positioned relative to the upper surface 154 of the lower beam flange 118 by the same dimensions as the upper beam slot 136 is positioned from the lower surface 146 of the upper beam flange 114.

Figure 13:
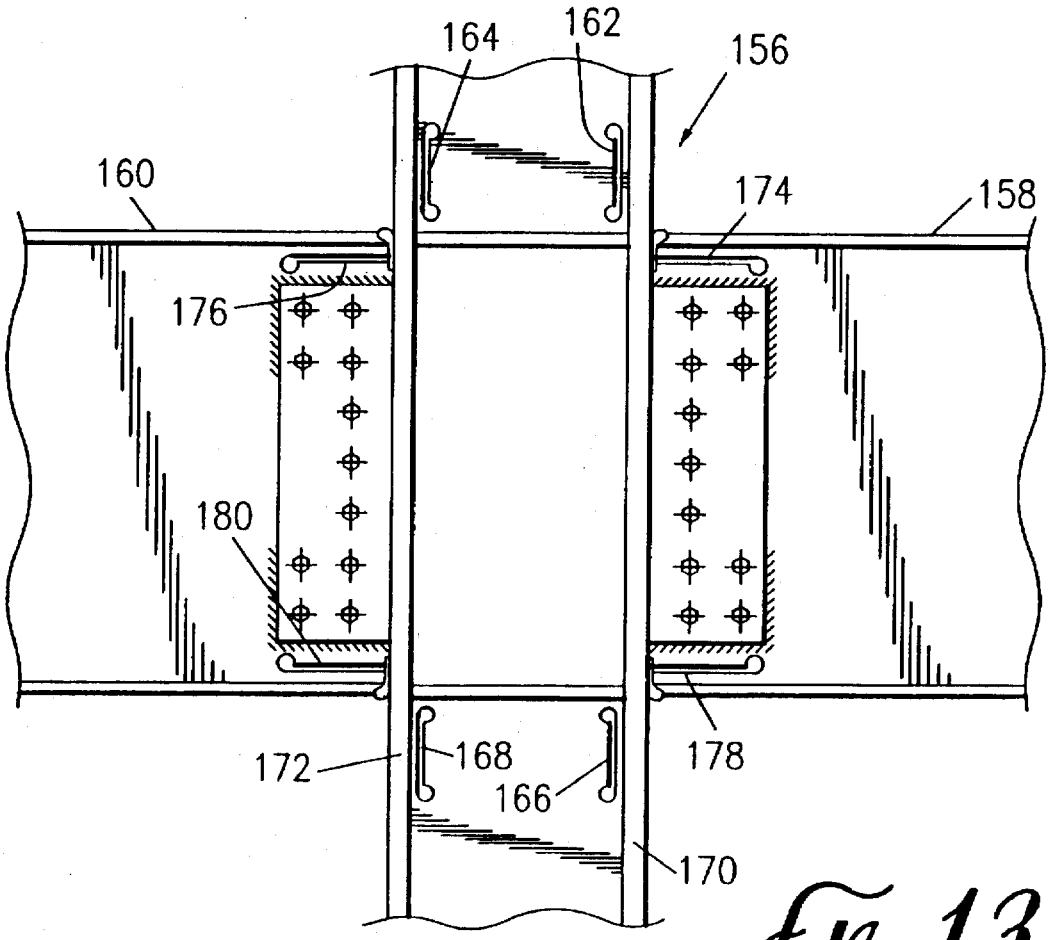
FIG. 13 is a side view of another preferred embodiment including a connection of two beams to a single column, upper and lower vertical column slots adjacent each of the two beams, and upper and lower horizontally extending beam slots for each of the two beams.

Referring to FIG. 13, a single column 156 having two connecting beams 158, 160 is shown. The column 156 includes upper column slots 162, 164 and lower column slots 166, 168, as described in greater detail above, adjacent to each of the column flanges 170, 172 connected to each of the two beams 158, 160. Also, each of the two beams is shown with upper beam slots 174, 176 and lower beams slots 178, 180 as described in greater detail above. The column and beam slots associated with the connection of beam 160 to column 156 are the mirror images of the slots associated with the connection of beam 158 to column 156, and have the dimensions as described in connection with FIGS. 9–12.

The slots may vary in orientation from vertical to horizontal and any angle in between. Orientation may also vary from slot to slot in a given application. Furthermore, the shape, or configuration of the slots may vary from linear slots as described herein to curvilinear shapes, depending on the particular application.

Double Beam Slots Features of the Present Invention

Figure 14:
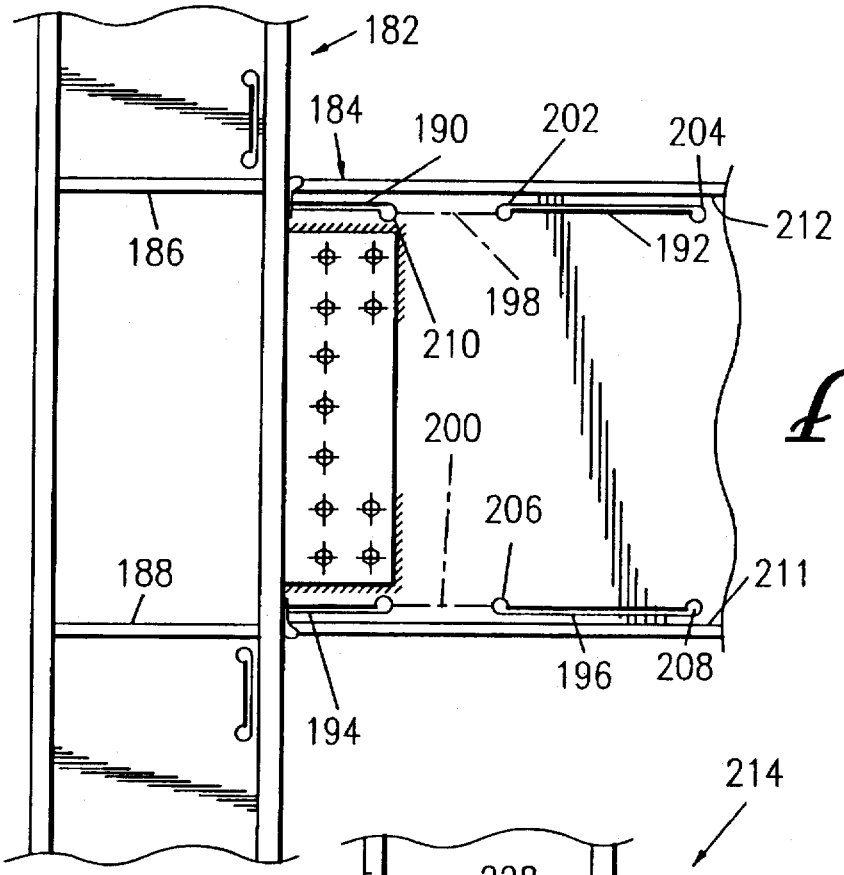
FIG. 14 is a side view of another preferred embodiment of the present invention including a column to beam connection with upper and lower, double beam slots and upper and lower vertically oriented column slots.

In accordance with conventional practice, many regulatory and/or design approval authorities may require modification of the conventional beam to column connection such that the beam plastic hinge point is moved away from the column to beam connection further along the beam than it otherwise would be in a conventional connection. Typically the minimum distance many in this field consider to be an acceptable distance for the plastic hinge point to be from the connection is D/2 where D is the height of the beam. In accordance with the present invention, and as illustrated in FIG. 14, column 182 is shown with beam 184 and continuity plates 186, 188 as described above. Beam 184 has upper beam slots 190 and 192, and lower beam slots 194 and 196. The beam slots immediately adjacent to the column 182 are described in greater detail above. The centerlines of second beam slots 192, 196 are positioned to be co-linear with the centerline of the first beam slots 190, 194. The second beam slots 192, 196 function to move the plastic hinge point further away from the beam to column connection. The second beam slots 192, 196 have two terminus holes each, and are oriented in the same fashion as the first beam slot, as shown at 202, 204, 206, 208, respectively. In a W 27×94 steel beam the preferred length of the second beam slot is 12 inches from terminus hole 202 center to hole 204 center, with 1 inch diameter terminus holes as shown in FIG. 14. Also, preferably, the center of the first terminus hole 202 of the second, upper beam slot 112 is a distance of 6 inches from the center of the terminus hole 210 of the first, upper beam slot 190. The centerlines of the terminus holes are co-linear to each other just outside the fillet area. The second beam slot is cut just outside the fillet area of the flange and in the web and the terminus holes are tangential to the slot, on the side of the holes closet to the nearest beam flange. The width of the second beam slot is, preferably, ¼ inch and extends through the entire thickness of the beam. Again referring to FIG. 14, second lower beam slot 196 is cut to be co-linear to the first lower beam slot 194. The second, lower beam slot 196 has dimensions, preferably, identical to the dimensions of the second, upper beam slot 192, and its position relative to the lower beam flange's upper surface 210 corresponds to the positioning of the second upper beam slot 192 relative to the lower surface 212 of the upper beam flange.

Although not shown in FIG. 14, the column slots, load plates, and/or support plates as described above may be used with the double beam slots.

Enlarged Shear Plate Feature of the Present Invention

Figure 15:
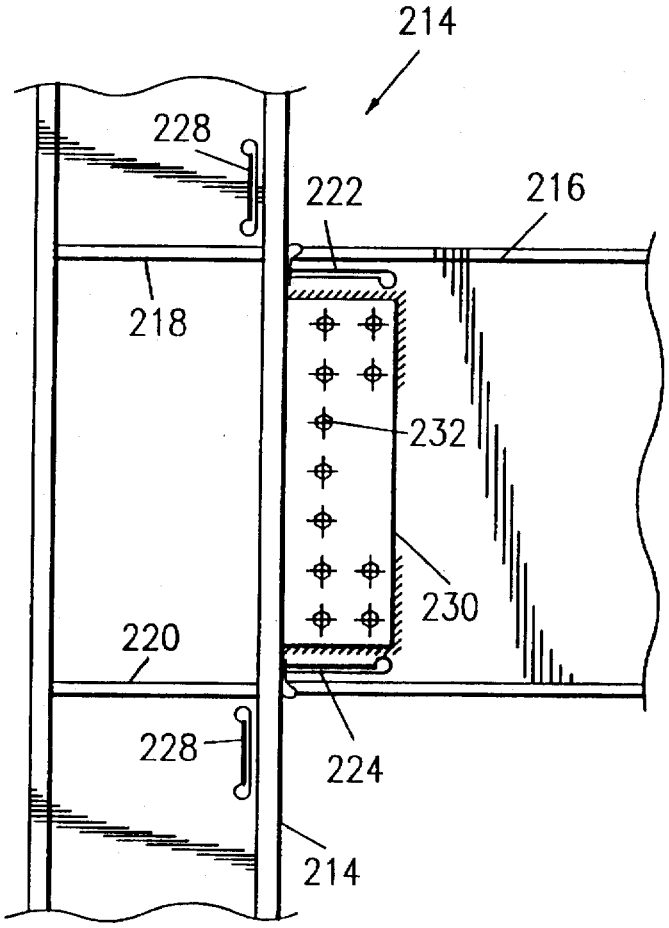
FIG. 15 is a side view of another preferred embodiment of the present invention, including a beam to column connection with the enlarged shear plate and column and beam slot.

Referring to FIG. 15, column 214, beam 216, continuity plates 218 and 220, upper beam slot 222, lower beam slot 224, upper column slot 226 and lower column slot 228 are shown with enlarged shear plate 230. Conventional shear plates typically have a width to accommodate a single row of bolts 232. In accordance with the present invention, the width of the shear plate 230 may be increased to accommodate up to three rows of bolts 232. The shear plate 230 of the present invention may be incorporated into the initial design and/or retrofitting of a building. In a typical steel frame construction employing a W 27×94 steel beam, a shear plate of approximately 9 inches in width would accommodate two columns of bolts. Typically, the bolt hole centers would be spaced apart by 3 inches. The enlarged shear plate inhibits the premature breaking of the beam web when the beam initiates a failure under load in the mode of a buckling failure.

Uses and Advantages of the Present Invention

The present invention may be used in steel frames for new construction as well as in retrofitting, or modifying, steel frames in existing structures. The specific features of the present invention, such as column slots and beam slots, and their location will vary from structure to structure. In general, the present invention finds use in the column web to beam flange interfaces where stress concentrations, as well as strain rate effect due to the stress concentrations, during high loading conditions, such as during earthquakes, are expected to reach or exceed failure. Identification of such specific connections in a given structure is typically made through conventional analytical techniques, known to those skilled in the field of the invention. The connection design criteria and design rationale are based upon analyses using high fidelity finite element models and full scale prototype tests of typical connections in each welded steel moment frame. They employ, preferably, program Version 5.1 or higher of ANSYS in concert with the pre-and post processing Pro-Engineer program. These models generally comprise four node plate bending elements and/or ten node linear strain tetrahedral solid elements. Experience to date indicates models having the order of 40,000 elements and 40,000 degrees of freedom are required to analyze the complex stress and strain distributions in the connections. When solid elements are used, sub-modeling (i.e., models within models) is generally required. Commercially available computer hardware is capable of running analytical programs that can perform the requisite analysis.

The advantages of the invention are several and respond to the uneven stress distribution found to exist at the beam flange/column flange connections in typical steel structures made from rolled steel shapes. Where previously the stress at the beam weld metal/column interface was assumed to be, for design and construction purposes, at the nominal or uniform level for the full width of the joint, the features of the present invention take into account and provide advantages regarding the following:

1. The stress concentration which occurs at the center of the column flange at the welded connection.
2. The strain levels in both the vertical and horizontal orientations across the welded joint.
3. The very high strain rams on the conventional joints at the center of the joint as compared with the very low strain rates at the edges of the joint.
4. The vertical curvature of the column and its effect on the conventional joint of creating compression and tension across the vertical face of the weld.
5. Horizontal curvature of the column flange and its effect on uneven loading of the weldment.
6. The features of the present invention can be applied to an individual connection without altering the stiffness of the individual connection.
7. Conventional analytical programs for seismic frame analysis are applicable with the present invention because application of the present invention does not change the fundamental period of the structure as compared to conventional design methods.

The stress in the conventional design without continuity plates in the column has been measured to 4 to 5 times greater than calculated nominal stress as utilized in design. With the improvements installed at a connection, we have shown a reduction in stress concentration factor at the "extreme fiber in bending" to a level of about 1.2 to 1.5 times the nominal design stress value. An added enhancement in connection performance has been created by elimination of a compression force in the web side of a flange which is loaded in tension. The elimination of this gradient of stress from compression to tension across the vertical face of the weld eliminates a prying action on the weld metal.

Example of Use of the Present Invention In Mathematical Models

Using a finite element analysis described above, several displacement analyses were performed on beam to column connections incorporating various features of the present invention, as well as on a conventional connection. Displacement of the edges of the column flanges and beam flanges was determined with the ANSYS 5.1 mathematical modeling technique.

Figure 16:
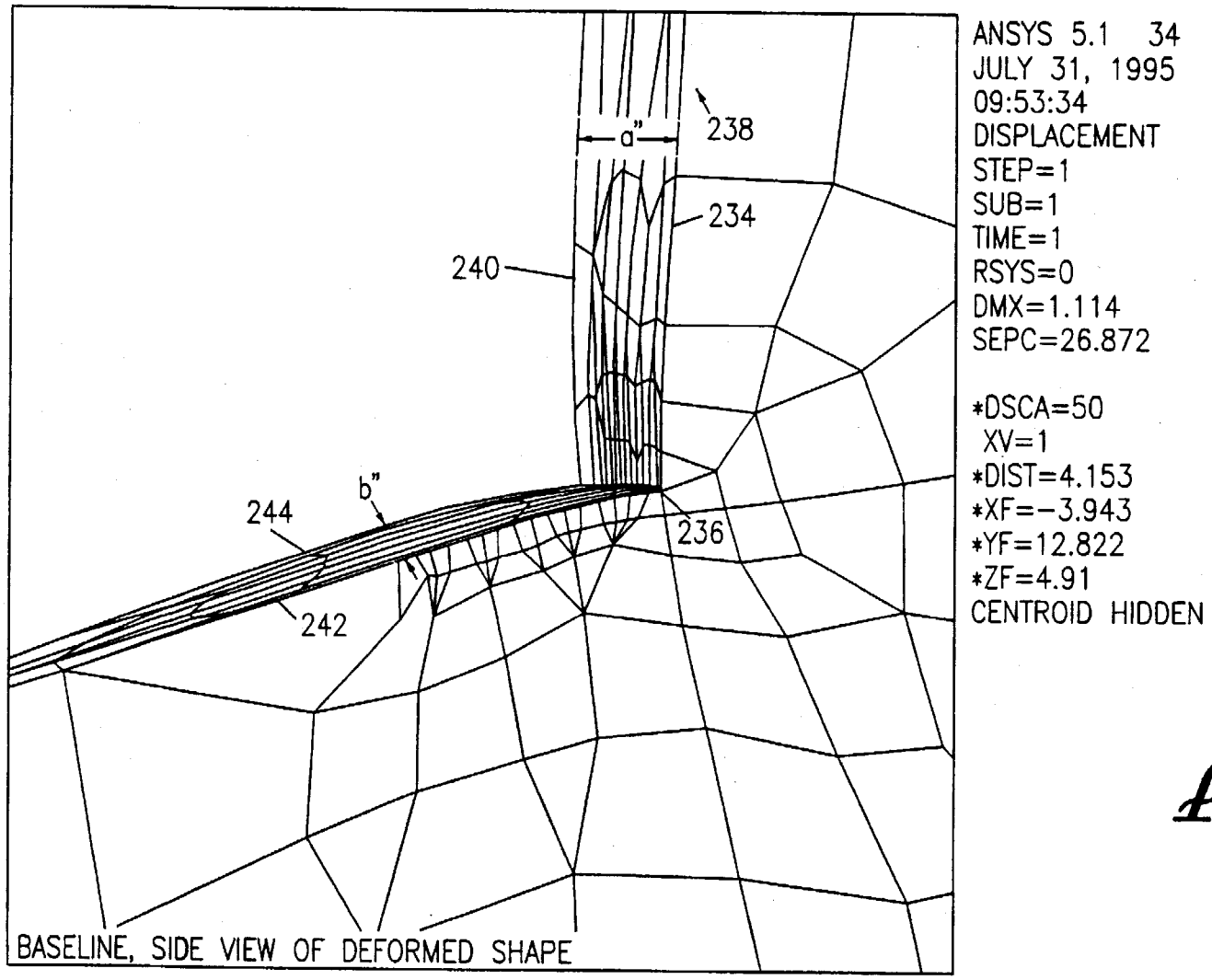
FIG. 16 is a graphical display of the displacement, based on a finite element analysis, of the column and beam flange edges of a conventional beam to column connection when under a load typical of that produced during an earthquake.
Figure 17:
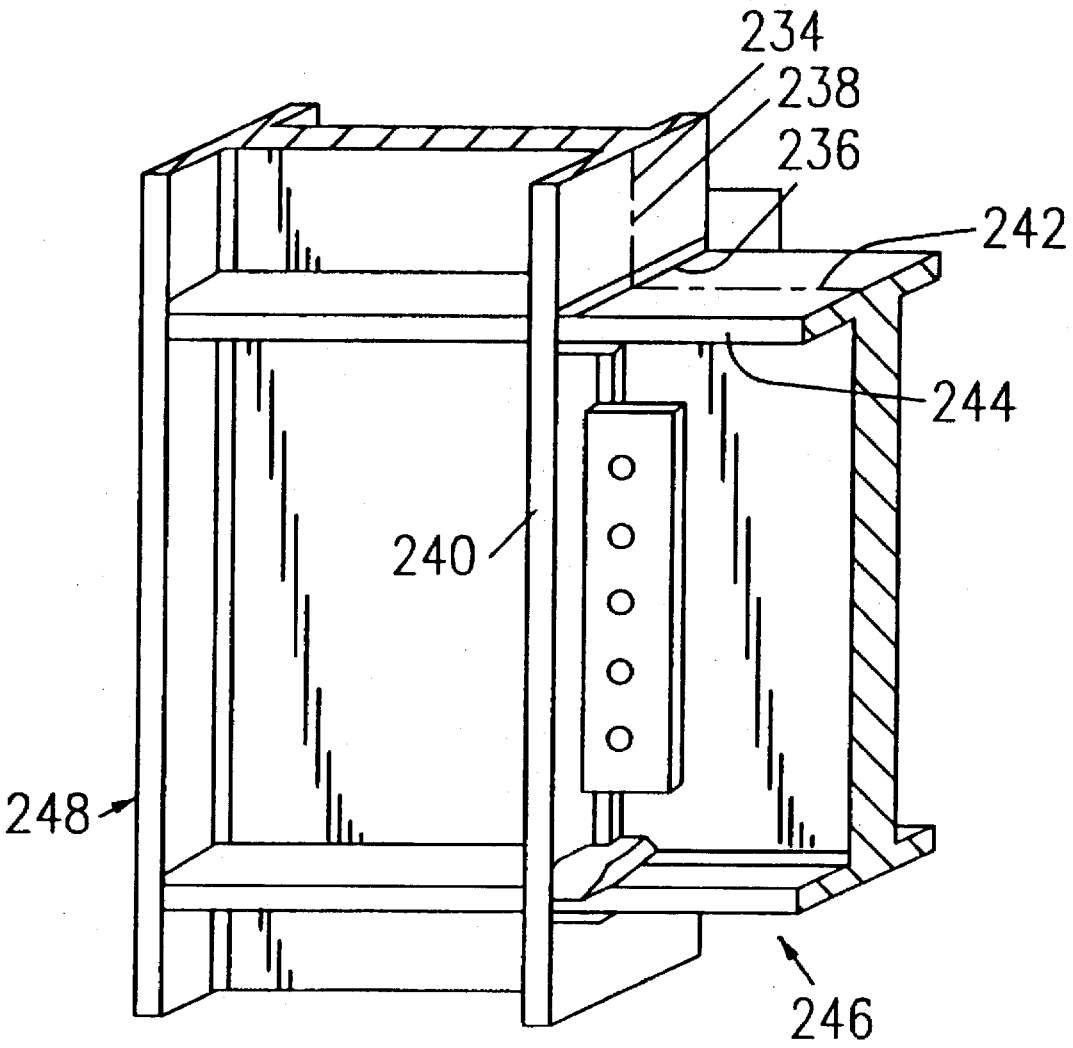
FIG. 17 is a side perspective view of the FIG. 16 connection.

Referring to FIG. 16, a display of the baseline displacement of the beam flange and column flange at a beam to column connection is shown for a conventional beam to column connection under given loading conditions approximating that which would occur during an earthquake. Line 234 represents the centerline of a column flange, with region at 236 being at the connection to a beam flange. Region 238 is near column flange centerline at some vertical distance away from the connection point of the beam to the column. For example, if region 236 represented a connection at an upper beam flange, then region 238 is a region near the column flange vertical centerline above the beam to flange connection. Line 240 represents a column flange outer edge. Line 242 represents the centerline of the connected beam flange and line 244 represents the beam flange outer edge. Referring to FIG. 17, a side perspective view of a conventional beam 246 to column 248 connection, the column centerline 234 is shown with region 238 vertically above the connection point center at 236. Similarly, beam flange centerline 242 is shown extending along the beam flange, in this case the upper beam flange, which is at the connection of interest. Outer column flange edge 248 and outer beam flange edge 244 are also shown. The distance "a" between the left vertical line 240 and the right vertical line 234 generally indicates the displacement of the flange edge during imposed loading. Thus, a great distance between the two lines indicates that there is a significant displacement of the edge 240 of the column flange compared to the column flange along its vertical center line 234 during the given loading event. Similarly, the distance "b" between beam center line 242 and the flange edge 244 is a measure of the displacement of the edge 244 of the beam flange from the center line 242 of the beam flange along its length from the column. FIG. 16 view shows the displacement for a conventional column 248 to beam 246 connection, not including any features of the present invention.

Figure 18:
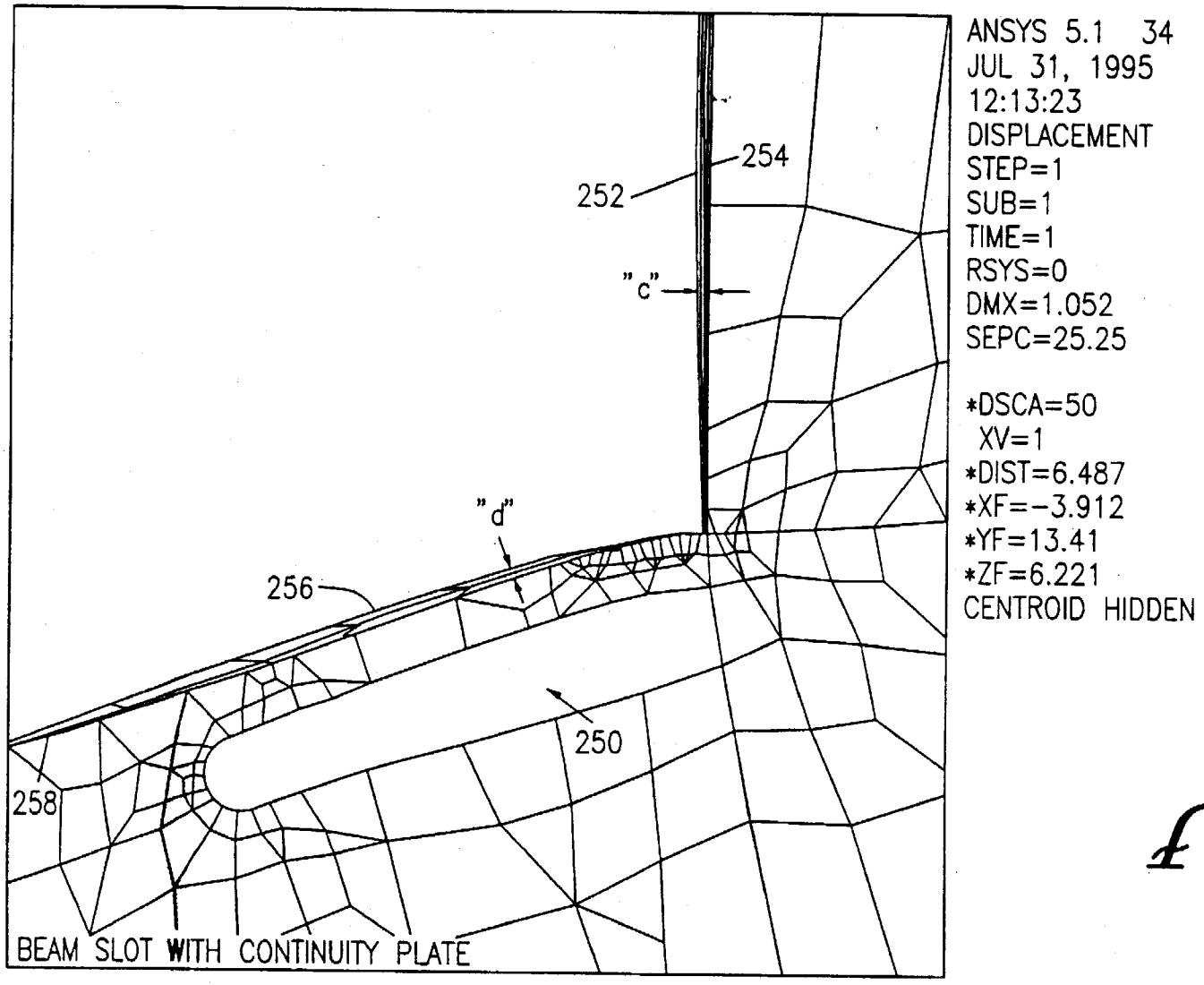
FIG. 18 is a graphical display of flange edge displacement, at the beam to column connection, in a connection using a conventional continuity plate and a horizontal beam slot of the present invention, when under a load typical of that produced during an earthquake.

Referring to FIG. 18, a view of the displacement for a beam to column connection having a beam slot with a continuity plate is shown. In FIG. 18, area 250 represents the beam slot. Line 252 represents the column flange edge, line 254 represents the column center line, line 256 represents the beam flange edge and line 258 represents the beam center line. Distance "c" represents displacement of column flange edge from centerline and distance "d" represents displacement of beam flange edge from beam flange centerline during the loading condition. The distances "c" and "d" represent significant displacements of the edges of the column of angle and beam flanges compared to that of the column and beam centerlines separately. As is readily apparent in comparing the distance "a", FIG. 16, to distance "c", FIG. 18, and distance "b" to distance "d", the amount of displacement is significantly less in the case where the beam slot is employed in the steel structure. The reduction of displacement in flange edges between the conventional connection and the connection with beam slots indicates the forces imposed during the loading event are more evenly absorbed in the connection with the beam slot.

Figure 19:
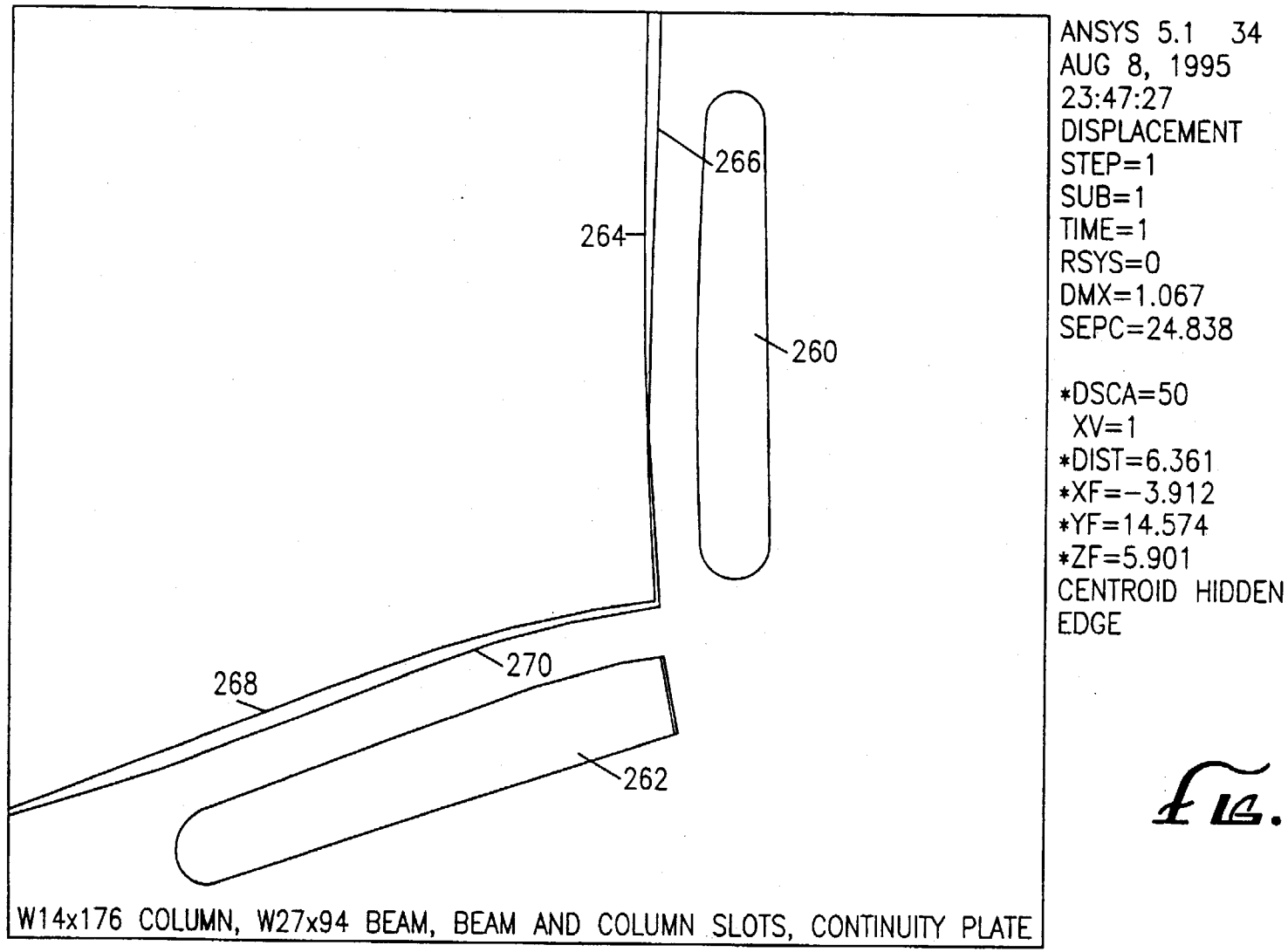
FIG. 19 is a graphical display of flange edge displacement, at the beam to column connection, for a connection with a column having a conventional continuity plate and incorporating beam and column slots of the present invention when under a load typical of that produced during an earthquake.

FIG. 19 is a view of the displacement of column and beam flange edges in a connection having beam and column slots as well as continuity plate for a W 14×176 column, connected to a W 27×94 beam. Region 260 represents the column slot, as described in greater detail above with reference to FIG. 9, 10, and 12 and region 262 represents a beam slot as described more fully above with reference to FIG. 9 and 11. Line 264 represents the column flange edge, line 266 represents the column center line, line 268 represents the beam flange edge and line 270 represents the beam flange center line. As is also readily apparent, the distance between the two vertical lines 264 and 266 and the distance between the two generally downwardly sloping, horizontal lines 268, 270, represent significantly less displacement between the edges of the flanges and the center line of the flanges for a connection having a column slot, beam slot and continuity plate than compared to the flange edge displacement in a conventional connection. This reduced displacement, as discussed above, indicates that the connection having beam and column slots with a continuity plate is able to more uniformly absorb the forces applied during the loading than is the conventional connection.

Figure 20:
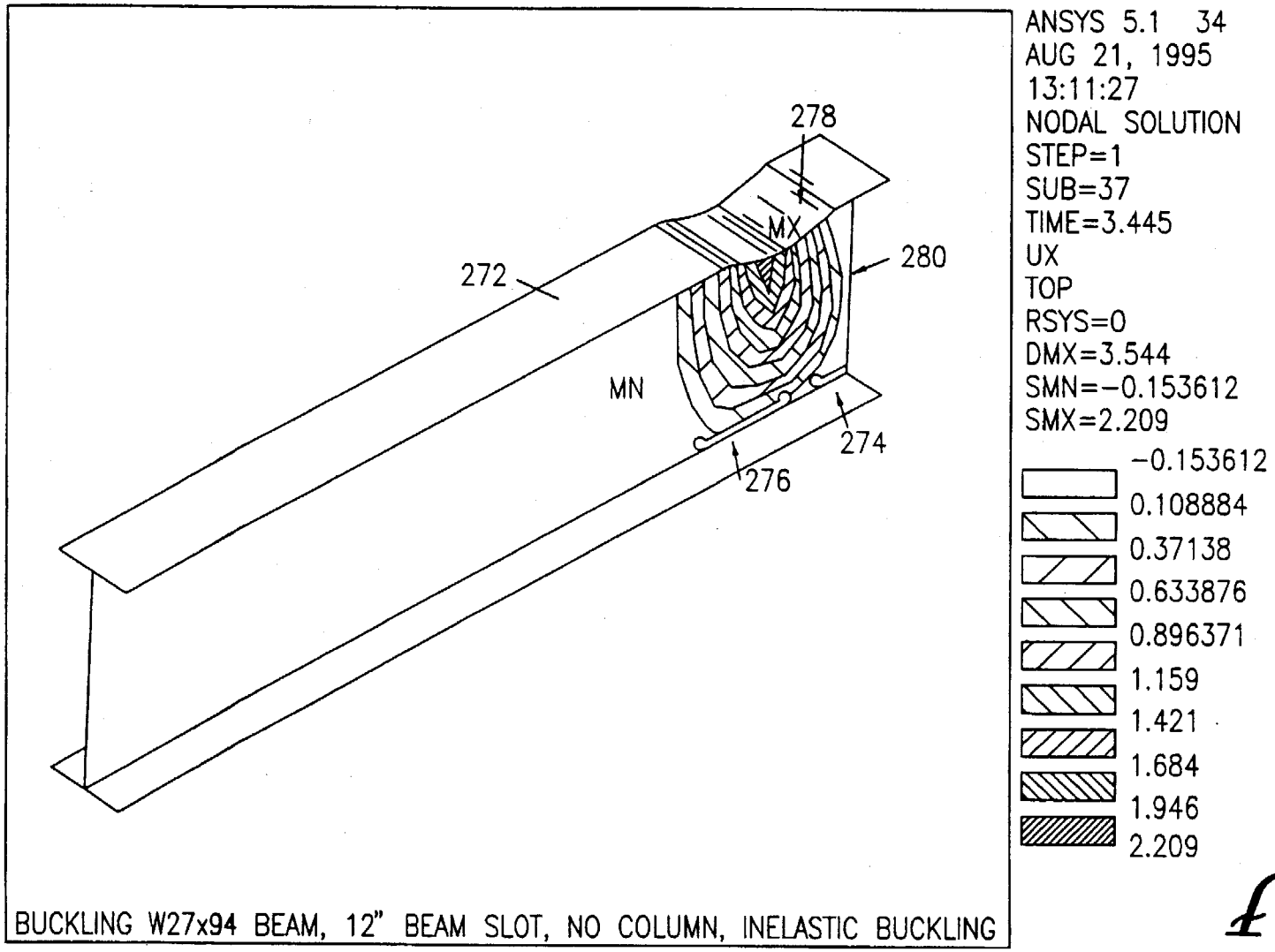
FIG. 20 is a drawing demonstrating buckling in a beam, based on a finite element analysis of a beam with double beam slots of the present invention, when the beam is placed under a load typical of that produced during an earthquake.

FIG. 20 illustrates buckling of a beam having the double beam slots of the present invention. Standard W 27×94 beam 272 includes lower first beam slot 274 and second, or double beam slot 276 as shown. Corresponding upper first and second beam slots are included in the analysis, but are not shown in FIG. 20 because they would be hidden by the overlapping of the upper beam flange. These double beam slots are as described above in regard to FIG. 14. Buckling of the beam is shown at region 278, the plastic hinge, in the upper beam flange, with the flange being deformed downward into a generally U-shape or V-shape. In the web of the beam deformation takes the shape of a region 280 of the web being forced out of its original plane and into a ridge, extending out of the page, as indicated in FIG. 20. As shown, the plastic hinge point is in the region of the web above and below the second upper and lower beam slots rather than at the beam to column connection itself.

Figure 21:
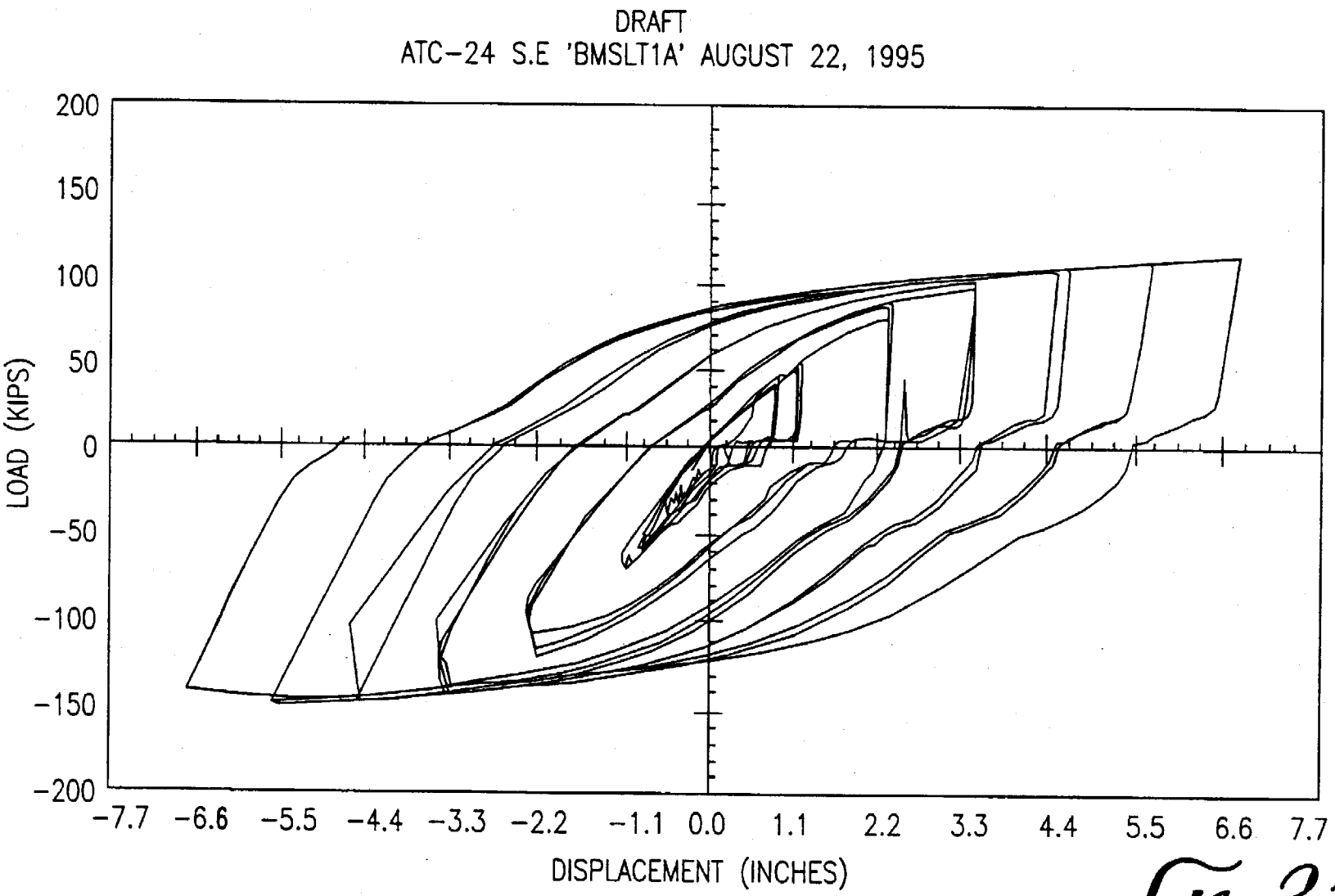
FIG. 21 is a hyderises loop of a beam to column connection including column and beam slots of the present invention, under simulated seismic loading similar to that resulting from an earthquake.

FIG. 21 is a graph of a hysteresis of a beam to column connection incorporating upper and lower column slots and upper and lower beam slots of the present invention, as shown in FIG. 9. The "hysteresis loop" is a plot of applied load versus deflection of a cantilever beam welded to a column.

Figure 25:
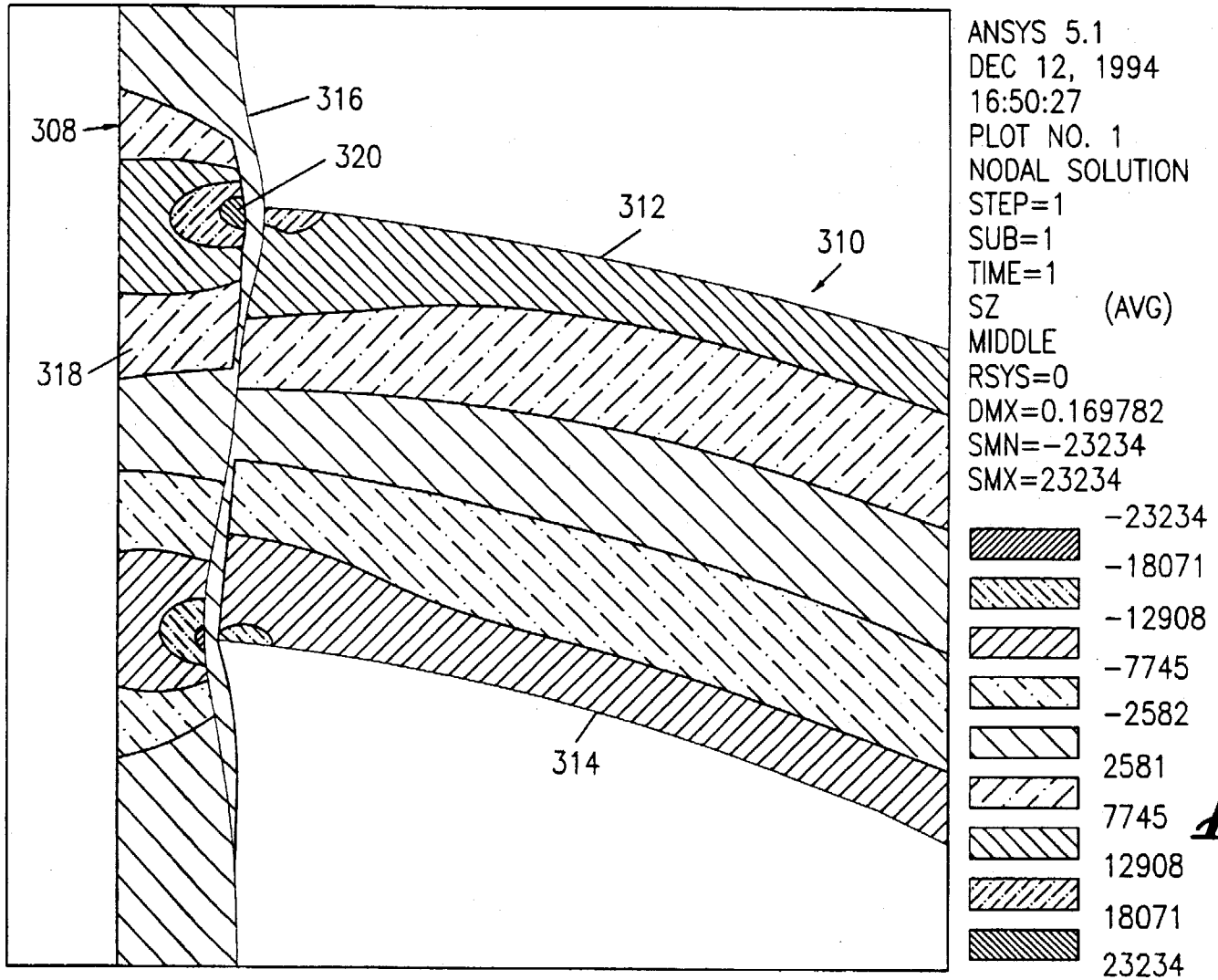
FIG. 25 is a drawing showing stresses in the connection at the top and bottom beam flanges.
Figure 20:
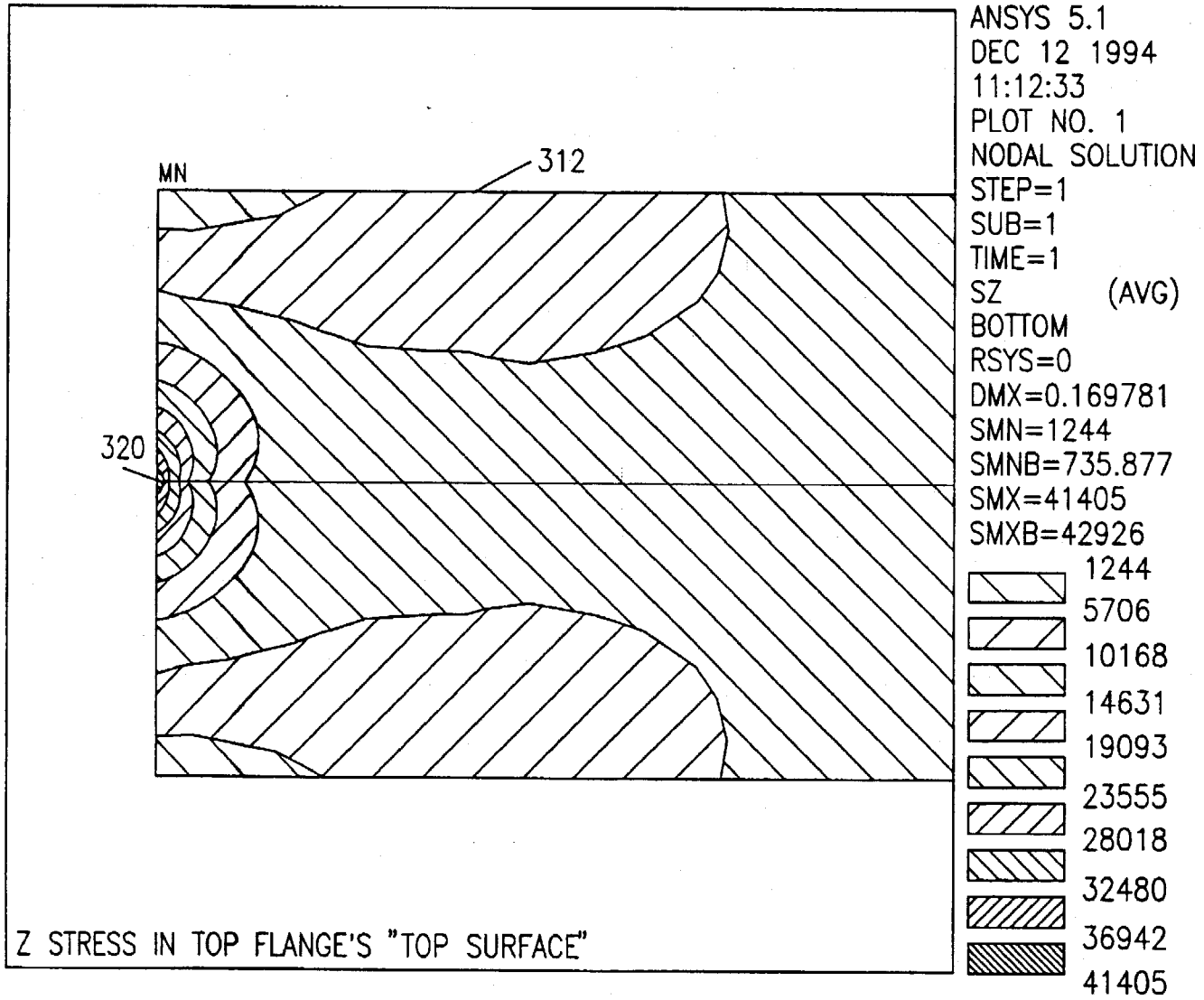

Referring to FIGS. 25 and 26, it has been discovered that the column 308 exhibits vertical and horizontal curvature due to simulated seismic loading. Due to the vertical curvature of the column flange 316, the beam 310 is subjected to high secondary stresses in the beam flanges 312 and 314. In addition, it has been discovered that horizontal curvature of the column flange 312 occurs due to the tension and compression forces in the beam flanges 312 and 314. Sharp curvature occurs in the beam flanges 312 and 314, which includes prying action in the beam flange 312 and 314 to column flange 316. The stresses converge toward the column web 318 and are highest in region 320. The purpose of the beam slot is to minimize the contribution of the vertical and horizontal curvature of the column flanges.

While the present invention has been described in connection with what are presently considered to be the most practical, and preferred embodiments, it is to be understood that the invention is not to be limited to the disclosed embodiments, but to the contrary, is intended to cover various modifications and equivalent arrangements included within the spirit of the invention, which are set forth in the appended claims, and which scope is to be accorded the broadest interpretation so as to encompass all such modifications and equivalent structures which may be applied or utilized in such manner to correct the uneven stress, strains and non-uniform swain rates resulting from lateral loads applied to a steel frame.

What is claimed is:

1. A steel framework comprising:

a steel column having a first flange, a second flange, and a web therebetween;

a steel beam having a first flange, a second flange, and a web therebetween;

the beam being welded orthogonal to the first flange of said column;

a slot in the beam positioned adjacent to the first flange of the beam and adjacent to the first flange of the column; and a slot in the column positioned adjacent to the column flange and to the beam flange nearest to the beam slot.

2. The framework of claim 1 further including:

the slot in the beam having a width, a thickness and a length dimension;

the thickness of the slot in the beam being equal to the thickness of the beam web, and the slot in the beam terminating at one end tangentially to a circular hole having a diameter greater than the width of the beam slot;

the slot in the column having a width, a thickness, a length dimension and two ends, and the slot in the column terminating tangentially at the two ends, each end being a circular hole having a diameter greater than the width dimension.

3. A steel framework comprising:

a steel column having a first flange, a second flange, and a web therebetween;

a steel beam having a first flange, a second flange, and a web therebetween;

the beam being welded orthogonal to the first flange of the column;

a first slot in the beam positioned adjacent to the first beam flange and to the first column flange; and a second slot in the beam positioned adjacent to the second beam flange and to the first column flange.

4. A steel framework comprising:

a steel column having a first flange, a second flange, and a web therebetween;

a steel beam having a first flange, a second flange, and a web therebetween;

the beam being welded orthogonal to the first flange of the column;

a first slot in the beam positioned adjacent to the first beam flange and to the first column flange;

a second slot in the beam positioned adjacent to the second beam flange and to the first column flange; and a slot in the column positioned adjacent to the column flange and to the beam flange nearest to the first beam slot.

5. A steel framework comprising:

a steel column having a first flange, a second flange, and a web therebetween;

a steel beam having a first flange, a second flange, and a web therebetween;

the beam being welded orthogonal to the first flange of the column;

a slot in the beam positioned adjacent to the first flange of the beam and adjacent to the first flange of the column;

a slot in the column positioned adjacent to the column flange and to the beam flange nearest to the beam slot; and a column web stiffener extending between the first and second column flanges and being co-planar with the first beam flange.

6. A steel framework comprising:

a steel column having a first flange, a second flange, and a web therebetween;

a steel beam having a first flange, a second flange, and a web therebetween;

the beam being welded orthogonal to the first flange of the column;

a first slot in the beam positioned adjacent to the first beam flange and the first column flange;

a second slot in the beam positioned adjacent to the second beam flange and to the first column flange; and a continuity plate extending between the first and second column flanges and being co-planar with the first beam flange.

7. In a load bearing and moment frame connection of a steel frame for a building having a horizontal beam welded at its upper end flange and welded at its lower end flange to an outer surface of a vertical column flange, and having a stress concentration factor in the order of 4.5 to 5.0 at the center of the upper and lower beam flange to column flange welds, the improvement comprising:

a first slot positioned in the beam web near the connection of the upper beam flange to the column flange;

the first slot having an open end near the connection of the upper beam flange to the column flange and a closed end in the beam web remote from the connection of the upper beam flange to the column flange;

a second slot positioned in the beam web near the connection of the lower beam flange to the column flange;

the second slot having an open end near the connection of the lower beam flange to the column flange and a closed end in the beam web remote from the connection of the lower beam flange to the column flange; and the first slot and the second slot having lengths sufficient to reduce the stress concentration factor of the connection to less than 4.0 at the upper and lower beam flange to column flange welds.

8. In a load bearing and moment frame connection of a steel frame for a building having a horizontal beam welded at its upper end flange and welded at its lower end flange to an outer surface of a vertical column flange, the improvement comprising:

a first hole positioned in the beam web near the connection of the upper beam flange to the column flange;

the first hole having length, width and thickness dimensions, with the length dimension being greater than the width and thickness dimension, an open end near the connection of the upper beam flange to the column flange and a closed end in the beam web remote from the connection of the upper beam flange to the column flange;

a second hole positioned in the beam web near the connection of the lower beam flange to the column flange;

the second hole having length, width and thickness dimensions, with the length dimension being the greatest dimension, an open end near the connection of the lower beam flange to the column flange and a closed end in the beam web remote from the connection of the lower beam flange to the column flange; and the length dimension of the first hole having an orientation at an angle between vertical and horizontal and the length dimension of the second hole having an orientation at an angle between vertical and horizontal.

9. A method of extending the useful life of a steel frame of a building located in areas where earthquakes occur including the steps of:

selecting a steel beam having two flanges and a web therebetween;

selecting a steel column having two flanges and a web therebetween;

creating a first slot in the beam web, with the first slot having a predetermined length and being positioned near one end of at least one beam;

creating a second slot in the beam web, with the second slot having a predetermined length and being positioned near the same end of said beam;

determining the length of the first beam webslot and the length of the second beam web slot to be sufficient to reduce stress concentration, under earthquake dynamic loading, to less than 4.0; and welding the beam orthogonal to the column.

10. A method for making a welded beam to column connection, in a steel frame building located in an earthquake prone area, and which connection exhibits reduced prying action on the weld metal during dynamic loading, comprising the steps of:

determining the location of the failure point of stress and strain for a conventional beam to column connection under a predetermined earthquake loading for the area;

selecting a steel beam having a first end, a top flange, a bottom flange and a web therebetween;

selecting a steel column having two flanges and a web therebetween;

removing from the web of the beam at the first end and near the top flange a section of the web to form a slot having an open end at the end of the beam and a closed end in the web;

removing from the web of the beam at the first end and near the bottom flange a section of the web to form a slot having an open end at the first end of the beam and a closed end in the web; and welding the top flange of the beam and the bottom flange of the beam to one of the two column flanges to form a connection in which the maximum magnitude of the stress and strain experience across each weld is reduced to below the failure point for stress and strain caused by said predetermined earthquake dynamic loading, and in which prying action on the weld metal is reduced thereby enhancing the connection performance under dynamic loading.

11. A method for relieving stress concentrations in a load bearing and moment frame connection of a steel frame having a welded beam to column connection with upper and lower beam flange to column flange welds, a steel beam due to seismic loads applied to the connection, comprising the steps of:

determining a first stress concentration factor for said connection;

determining a total amount of steel to be removed from the web of the beam to yield a second stress concentration factor having a value less than that of said first stress concentration factor, said first stress concentration factor and second stress concentration factor being determined at the upper and lower beam flange to column flange welds of the connection;

removing a first portion of steel from the beam web near the upper beam flange and column flange weld; and removing a second portion of steel from the beam web near the lower beam flange and column flange weld;

whereby the total amount of first portion and amount of second portion of steel removed from the beam is equal to said total amount of steel removed.

12. A method of extending the useful life of load bearing and moment frame connections in a steel frame of a building located in areas where earthquakes occur by providing for stress concentration relief in the connections during seismic loading, including the steps of:

selecting at least one steel beam having a first end, a second end, a first steel flange, a second steel flange and a steel web therebetween;

selecting a steel column having two flanges and a web therebetween;

forming two holes in the steel beam web by;

removing a first section of steel from the beam web near the first end of the beam to form a first hole in the beam web positioned near the first end of the beam, the first beam hole having a predetermined length, width and thickness;

removing a second section of steel from the beam web near the second end of the beam to form a second hole in the beam web positioned near the second end of the beam, the second beam hole having a predetermined length, width and thickness;

welding the beam orthogonal to the column; and repeating the above steps for a predetermined number of beams and columns to form a predetermined number of connections in the steel frame.

13. The method of claim 12 wherein the thickness of each hole equals the thickness of the beam web, and width of each hole is about ¼ inch and length of each hole in the beam web is at least 3 times the thickness of the beam web.

14. The method of claim 11 wherein each hole has a length dimension greater than its width and thickness dimension, and the steps of removing the first section of steel and removing the second section of steel further include the steps of:

removing the first section of steel to provide a length dimension that is oriented at an angle between vertical and horizontal; and removing the second section of steel to provide a length dimension that is oriented at an angle between vertical and horizontal.

* * * * *